US011819753B2

(12) United States Patent
Smith et al.

(10) Patent No.: US 11,819,753 B2
(45) Date of Patent: Nov. 21, 2023

(54) BALL GLOVE HAVING BALL SPIN REDUCTION WEBBING

(71) Applicant: Wilson Sporting Goods Co., Chicago, IL (US)

(72) Inventors: Ryan J. Smith, Grayslake, IL (US); Robert T. Thurman, Glenn Ellyn, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 293 days.

(21) Appl. No.: 17/211,324

(22) Filed: Mar. 24, 2021

(65) Prior Publication Data

US 2021/0299545 A1 Sep. 30, 2021

Related U.S. Application Data

(60) Provisional application No. 62/994,463, filed on Mar. 25, 2020.

(51) Int. Cl.
*A63B 71/14* (2006.01)
*A63B 102/18* (2015.01)

(52) U.S. Cl.
CPC ..... *A63B 71/143* (2013.01); *A63B 2102/18* (2015.10); *A63B 2102/182* (2015.10); *A63B 2209/00* (2013.01)

(58) Field of Classification Search
CPC ..... A63B 2069/0011; A63B 71/143; A41D 19/01547; A41D 2400/80
See application file for complete search history.

(56) References Cited

U.S. PATENT DOCUMENTS 1,056,909 A * 3/1913 King ..... A63B 71/143 2/19
3,321,771 A * 5/1967 Latina ..... A63B 71/143 D29/115
4,339,830 A * 7/1982 Sasaki ..... A63B 71/143 2/19
4,541,126 A 9/1985 Howard et al.
4,908,880 A * 3/1990 Clevenhagen ..... A63B 71/143 2/19
5,367,712 A * 11/1994 Smith ..... A41D 19/015 2/161.1
5,402,537 A * 4/1995 Kolada ..... A63B 71/143 2/161.1
6,182,289 B1 2/2001 Brown
6,412,113 B1 7/2002 Guenther et al.
(Continued)

FOREIGN PATENT DOCUMENTS

JP S61143081 * 6/1986
WO WO-2009023026 A1 * 2/2009 ..... A41D 19/01564

OTHER PUBLICATIONS

English translation of Tanaka JPS61143081, obtained via espacenet.com (last visited Jun. 9, 2023). (Year: 2023).*
(Continued)

*Primary Examiner* — Patrick J. Lynch
(74) *Attorney, Agent, or Firm* — Terence P. O'Brien; Todd A. Rathe

(57) ABSTRACT

A ball glove may include a front glove portion, a back glove portion and a webbing. A palm side of the webbing comprises a spin reduction texture. The spin reduction texture includes a first pattern of raised projections and/or recesses.

13 Claims, 18 Drawing Sheets

(56) References Cited

U.S. PATENT DOCUMENTS

| | | | | |
|---|---|---|---|---|
| 6,553,571 | B1 | 4/2003 | Guenther et al. | |
| 6,571,394 | B1 | 6/2003 | Hackett et al. | |
| 6,634,029 | B1 | 10/2003 | Sullivano et al. | |
| 6,654,959 | B1 * | 12/2003 | Alpert | A63B 71/146 2/19 |
| 6,681,401 | B1 * | 1/2004 | Marino | A63B 71/143 2/19 |
| 6,711,745 | B2 | 3/2004 | Sullivano et al. | |
| 6,766,531 | B2 | 7/2004 | Sullivano et al. | |
| 7,013,486 | B1 | 3/2006 | Sullivano et al. | |
| 7,111,326 | B1 | 9/2006 | Sullivano et al. | |
| D583,105 | S | 12/2008 | Udelhofen et al. | |
| D583,106 | S | 12/2008 | Udelhofen et al. | |
| 10,368,596 | B2 | 8/2019 | Aso | |
| 11,000,083 | B2 * | 5/2021 | Visokey | A41D 19/0024 |
| 2001/0014979 | A1 * | 8/2001 | Park | A63B 71/143 2/19 |
| 2008/0216202 | A1 * | 9/2008 | Lin | A63B 71/143 2/163 |
| 2009/0113592 | A1 * | 5/2009 | Iwata | A41D 19/01523 36/114 |
| 2009/0300814 | A1 * | 12/2009 | Kume | A63B 71/143 2/19 |
| 2010/0248873 | A1 * | 9/2010 | Cooper | A63B 43/008 428/196 |
| 2013/0167281 | A1 * | 7/2013 | Jennings | B29C 35/002 156/196 |
| 2016/0144265 | A1 * | 5/2016 | Ramirez | A63B 57/207 2/161.3 |
| 2017/0368444 | A1 * | 12/2017 | Fang | A63B 71/143 |
| 2018/0043232 | A1 * | 2/2018 | Perry | A63B 71/148 |
| 2018/0117444 | A1 * | 5/2018 | Killough | G09F 21/02 |

OTHER PUBLICATIONS

Image of web page (https://www.justballgloves.com/product/ssk-red-line-11-5--dimple-baseball-glove-s19r115/30956/) showing SSK Red Line 11.5 Dimple Baseball Glove: S19IW9901R. Web page image retrieved on Oct. 5, 2022.

Image of web page (https://www.ssksports.com/profile/history.html). Web page image retrieved on Oct. 5, 2022.

* cited by examiner

BALL GLOVE HAVING BALL SPIN REDUCTION WEBBING

CROSS-REFERENCE TO RELATED APPLICATION

The present non-provisional patent application claims priority under 35 U.S.C. § 119 from U.S. provisional patent application Ser. No. 62/994,463 filed on Mar. 25, 2020 by Smith et al. and entitled BALL GLOVE HAVING BALL SPIN REDUCTION TECHNOLOGY, the full disclosure of which is hereby incorporated by reference.

FIELD OF THE INVENTION

The present invention relates generally to a ball glove for baseball, softball and other sports. In particular, the present invention relates to a ball glove including ball spin reduction technology to facilitate a ballplayer's ability to catch, grasp and retrieve a ball during play.

BACKGROUND OF THE INVENTION

Ball gloves for use in baseball, softball and other sports are well known. Ball gloves typically include a front panel connected to a corresponding back panel to form a hand cavity. The front and back panels typically generally resemble the shape of a human hand and when assembled form five stalls for receiving the thumb and fingers of a user's hand. The front and back panels form a hand opening at the lower edge of the glove. A webbing is typically connected between the thumb stall and the index finger stall of the ball glove. Ball gloves also typically include a hand opening for enabling a user to insert his or her hand into the hand cavity of the ball glove, and, often, an index finger hole for enabling the user's index finger to rest on the back portion of the index finger stall during use. Many existing ball gloves are formed of high quality, relatively expensive materials, such as natural leather, synthetic leather, and combinations thereof.

Ball gloves are generally constructed of highly durable materials to withstand the repeated impact of fielded balls during play and the scrapes and other contact with the playing field and other objects during play. Also, ball gloves are generally sized to be much larger than the hand of the ball player. The increased size is desirable in that it provides a larger pocket, or catching area for receiving a ball during play, enabling a player to reach more balls in play than would otherwise be possible with a glove matching the size of a player's hand. The size of a ball glove also typically varies by position. An outfielder's ball glove is typically larger than infielder's ball glove, and a first baseman's ball glove is typically larger than an outfielder's glove.

In many baseball game plays, the player's ability to catch the ball with a ball glove, grasp and retrieve the ball within the ball glove, and throw the ball is critical in determining whether the play will be considered a success or a failure (an out or a safe baserunner). Infielders desire to quickly field, retrieve and throw ground balls in order to throw out baserunners. Catchers desire to catch, retrieve and throw a pitched ball in order to throw out a baserunner attempting to steal a base. Outfielders desire to quickly field, retrieve and throw hit balls back to the infield in order to throw a baserunner out or to limit the progress of a baserunner about the base paths. A fraction of a second can be the difference between a baserunner being called out or safe. Pitched and hit baseballs and softballs typically include some amount of spin, including side spins, top spins and back spins. It is well-known that a high spinning baseball or softball can be more difficult to field for a player than a non-spinning or low spinning baseball or softball. A high spinning ball can be more difficult for a player to field, to retain in his or her ball glove, and to retrieve from his or her ball glove due to the rotation of the ball.

SUMMARY

The present disclosure describes an example ball glove configured for catching a ball. The ball glove includes a front glove portion, a back glove portion and a webbing. The webbing has a front face that forms a pocket of the glove. The webbing provides the ball glove with a large catching surface for cradling a ball that is caught. The webbing also provides the ball glove with a surface for absorbing the initial impact of a ball being caught, reducing impacts directly to the player's hand within the glove. As a result, it is often desirable to catch a ball using the webbing 16 of the ball glove.

The webbing includes a spin reduction texture. The spin reduction texture includes a first pattern of raised projection and/or recesses. Because the spin reduction texture is specifically provided on the webbing, the spin reduction texture is able to reduce spin of a caught ball almost immediately following impact of the ball with the ball glove. Moreover, because the spin reduction texture is specifically provided on the webbing as compared to other portions of the ball glove, a larger percentage of caught balls undergo spin reduction and are more easily retrieved from the pocket of the ball glove.

The example ball gloves will become more fully understood from the following detailed description, taken in conjunction with the accompanying drawings described herein below, and wherein like reference numerals refer to like parts.

DETAILED DESCRIPTION

Figure 1:
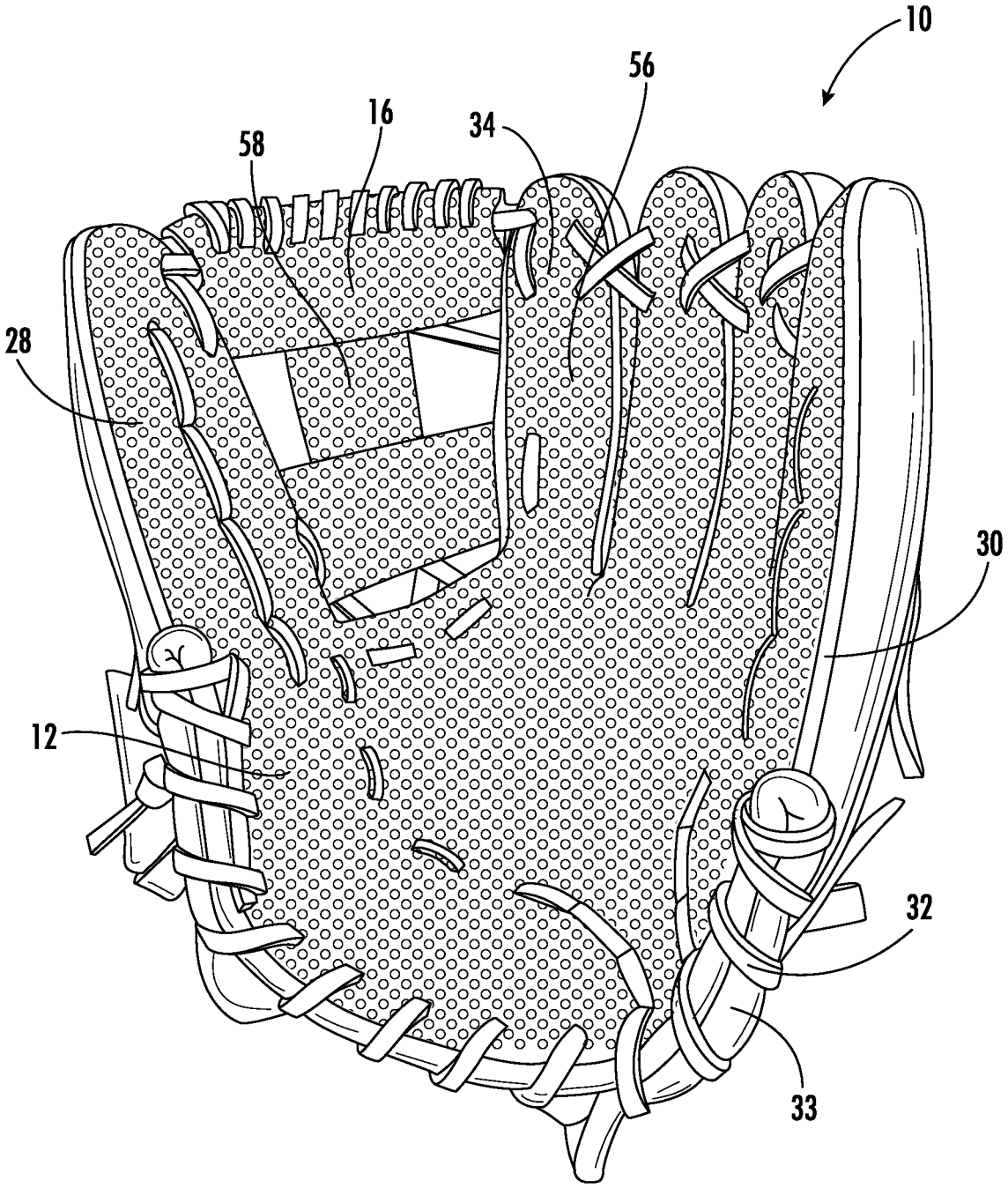
FIG. 1 is a palm or front side perspective view of a ball glove in accordance with one implementation.

Referring to FIGS. 1 through 7, a ball glove is indicated generally at 10. The ball glove 10 is configured for use in baseball, softball and other sports involving ball gloves. The ball glove 10 can also be referred to as a mitt. The present invention is directly applicable to any ball glove or ball mitt including, for example, a first baseman mitt and a catcher's mitt. The ball glove 10 includes a front glove portion 12, a back glove portion 14 and a webbing 16.

The front and back portions 12 and 14 are contoured sheet-like structures, each generally resembling a hand. The front portion 12 is coupled to the back portion 14. The term "coupled" refers to the direct or indirect connection, joining or linking of one component, part or article to another. The use of the term "coupled" can be interpreted in a manner similar to its use with railroad cars. A train engine can be directly connected to a caboose, or one, two, ten or any number of train cars can be linked between the engine and the caboose of a train. In both of these examples whether directly connected or indirectly linked by one or more train cars, the train engine is coupled to the caboose.

The front and back portions 12 and 14 are connected together to define a hand opening 17 and a hand cavity 18, and to form first, second, third and fourth finger stalls 20, 22, 24, 26, and a thumb stall 28. Each finger and thumb stall 20-28 defines an elongate cavity for receiving the respective finger or thumb of the user. The front and back portions 12 and 14 are preferably stitched together. In one preferred embodiment, the front and back portions 12 and 14 are coupled together through the use of weltings 30. Alternatively, the front and back portions 12 and 14 can be connected through other means, such as, for example, lacings 32, bonding, molding or adhesives and combinations thereof.

In some implementations, a binding 33 can be used at one or more edges of the front and/or back portions 12 and 14. The binding 33 generally wraps around and covers the edges of the front and back portions. The binding 33 can be stitched to one or more pieces of the front and/or back portions 12 and 14. Alternatively, the binding 33 can be coupled to the front and back stall portions through adhesives, stapling or other conventional fastening means. The binding 33 is preferably formed of a generally flexible, durable material, such as leather. Alternatively, the binding 33 can be formed of other materials, such as, for example, synthetic leather, plastic, other polymeric materials, composite materials, rubber, and combinations thereof. The binding 33 can be formed of one or more colors or textures, which can match or differ from the color and texture of the front and back portions 12 and 14. The binding 33 can also be formed to be stiffer and/or harder than the material forming the front and back portions to further strengthen or stiffen particular regions of the ball glove 10. The binding can be formed of one or more pieces or layers.

The front portion 12 covers and protects the palm-side of the user's hand from impact with the ball. The back portion 14 supports the front portion 12 and protects the backside of the user's hand. The front and back portions 12 and 14 are made of a pliable, durable, and relatively soft material, preferably leather. In alternative preferred embodiments, the front and back portions 12 and 14 can be made of other materials, such as, for example, artificial leather, composite leather, rubber, plastic, other polymers and combinations thereof. The front and back portions 12 and 14 can including a binding 42

The webbing 16 is a generally flat structure that is connected, and preferably stitched and/or laced, to the front and back portions 12 and 14 between the first finger stall 20 and the thumb stall 28. The webbing 16 provides the ball glove 10 with a large catching surface for cradling a ball that is caught. The webbing 16 also provides the ball glove 10 with a surface for absorbing the initial impact of a ball being caught, reducing impacts directly to the player's hand within the glove.

The finger stalls 20-26 and the thumb stall 28 are elongate cavities adapted for receiving the fingers and thumb of the user. Each finger stall 20-26 and thumb stall 28 includes a front stall portion 34 of the front portion 12 and a back stall portion 36 of the rear portion 14. Each finger stall 20-26 and thumb stall 28 also includes a distal region 38 and a proximal region 40. The front and back stall portions 34 and 36 are coupled to each other, preferably through the plurality of weltings 30, lacings 32 and stitchings. Alternatively, the front and back stall portions 34 and 36 can be connected through other means, such as, for example, stitching only, bonding, other fasteners or molding. In order to facilitate the fielding of balls during play, the ball glove 10 is typically larger than the hand of the user. In particular, the finger and thumb stalls 20-28 are typically significantly longer than the length needed to accommodate the user's fingers and thumb.

As shown by FIGS. 1-7, the front surface 58 of webbing 16 is specifically provided with a spin reduction texture 52. The spin reduction texture 52 may include a first pattern of raised projections and/or recesses. In the implementation of FIGS. 1 through 7, the spin reduction texture 52 is a first pattern of rounded dimples or recesses. In other implementations, the spin reduction texture can include patterns of raised projections, or combinations of raised projections and recesses. The recesses can have a depth within the range of 0.2 to 2.0 mm. In another implementation, the depth of the recesses can be within the range of 0.3 to 1.5 mm. The projections can have a height within the range of 0.2 to 2.0 mm. In another implementation, the height of the projections can be within the range of 0.3 to 1.5 mm. The spin reduction texture 52 illustrated in FIGS. 1 through 7 includes circular shaped recesses. In other implementations, the recesses can take other shapes including triangular shapes, rectangular shapes, pentagonal shapes, other polygonal shapes, elongated shapes, irregular shapes and combinations thereof. In other implementations, the spin reduction texture 52 can include projections or recesses taking one or more of the above-listed shapes.

The spin reduction texture 52 increases the static coefficient of friction of the surface upon which it is applied, such as the front surface 58 of webbing 16. As a result, the increased coefficient of friction caused by the spin reduction texture 52 facilitates the player's ability to field, grasp and retrieve a hit, pitched or thrown ball. The spin reduction texture 52 with its increased coefficient of friction can reduce the spin of a hit, pitched or thrown ball more quickly that a ball glove front portion without spin reduction texture.

Figure 5:
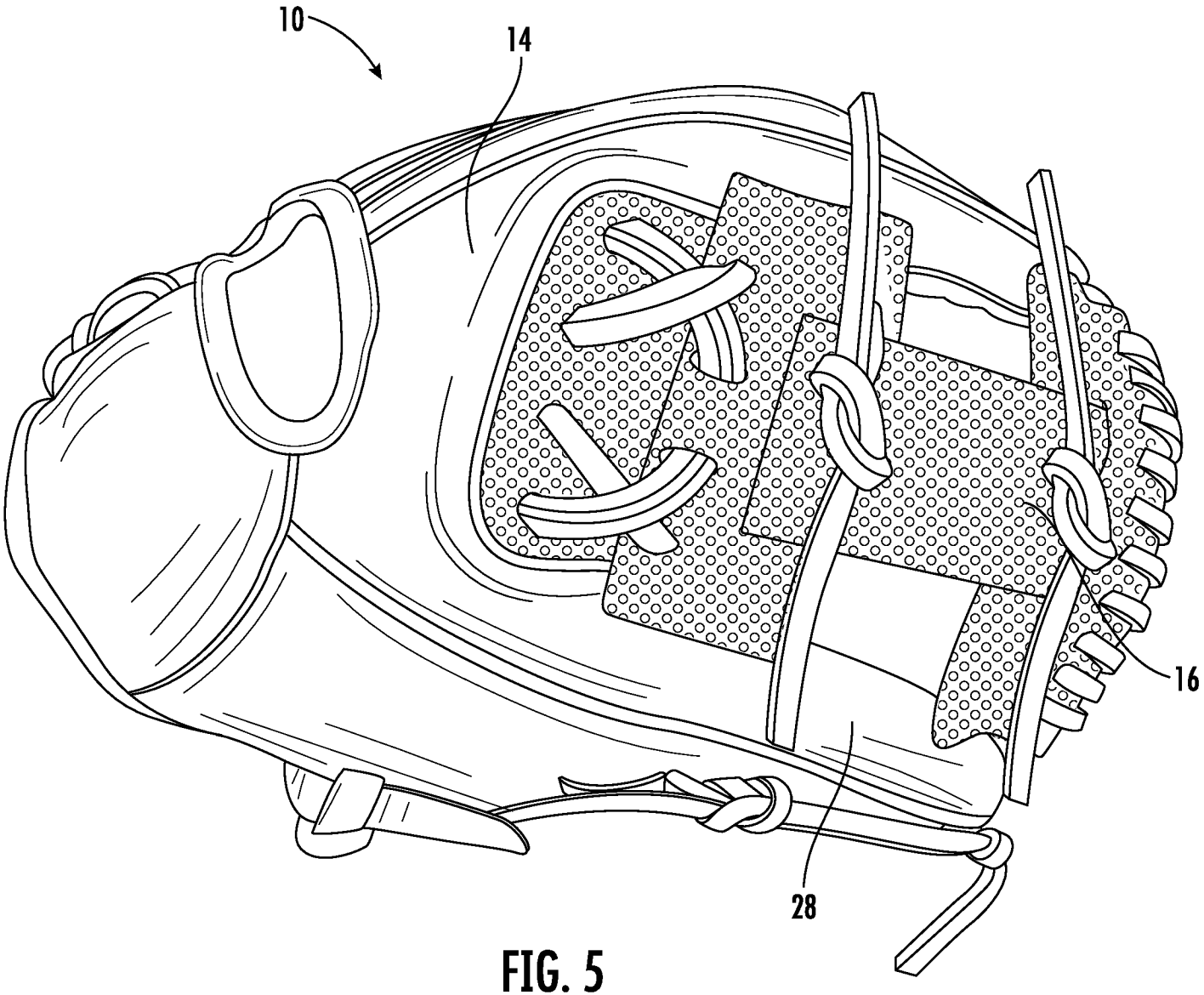
FIG. 5 is a back side perspective view of the ball glove of FIG. 1.
Figure 6:
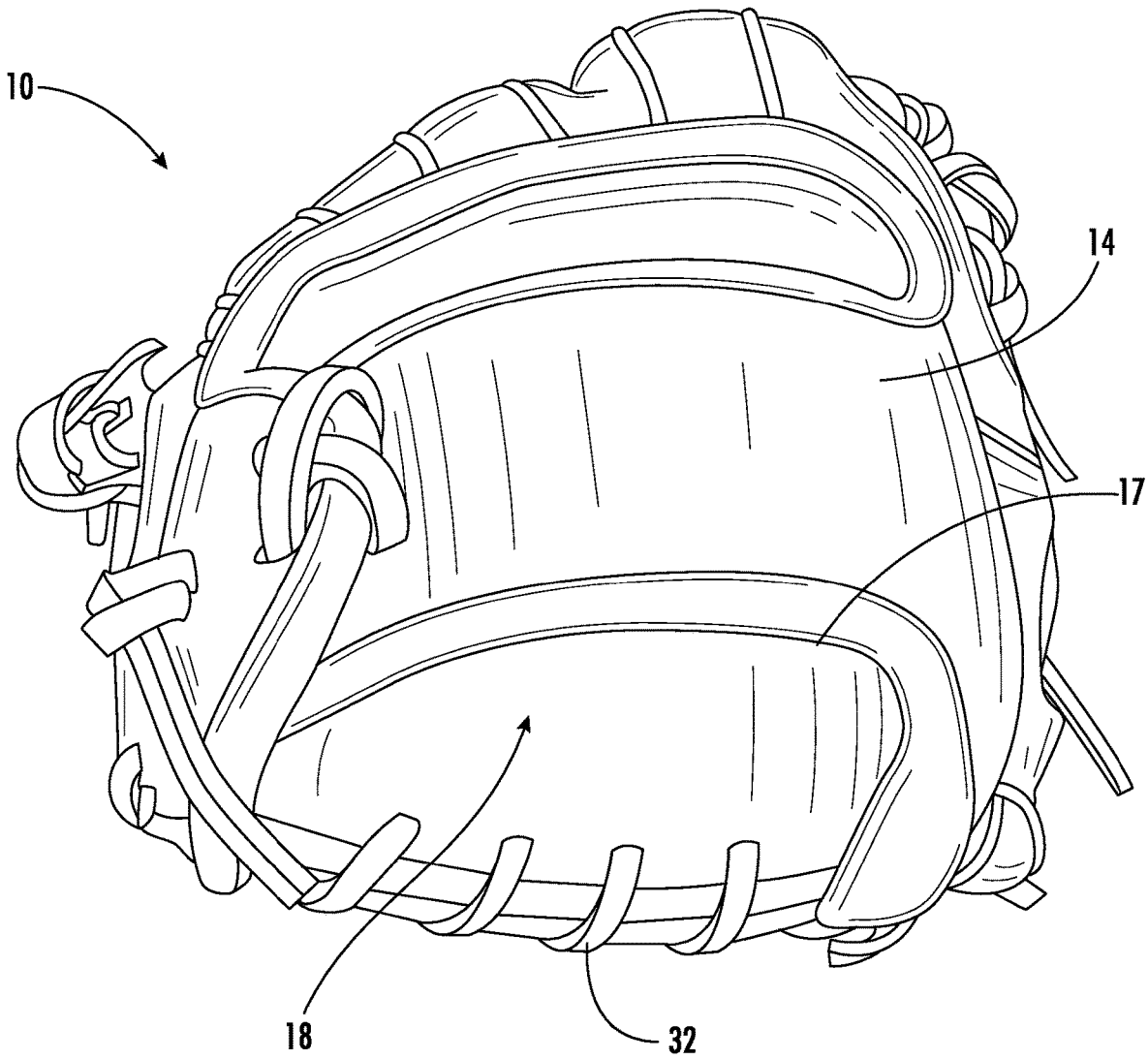
FIG. 6 is an end view of the ball glove of FIG. 1.
Figure 7:
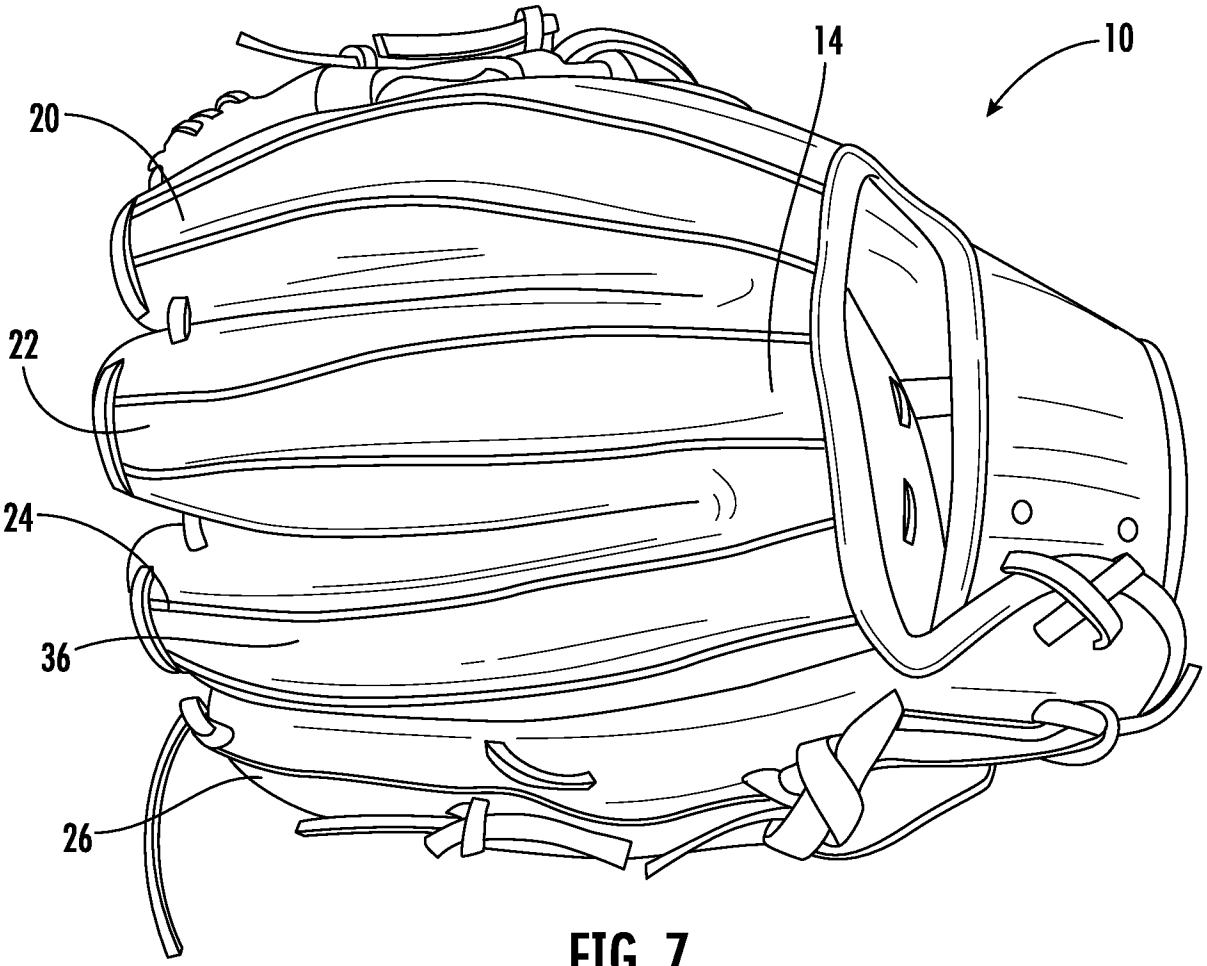
FIG. 7 is another back side perspective view of the ball glove of FIG. 1.

As shown by FIGS. 1-7, although having a lower impact, the spin reduction texture 52 may additionally extend about one or more of the palm region 54, the front stall portion 34 of the finger stalls 20, 22, 24 and 26, a front stall portion 56 of the thumb stall 28. In the implementation shown in FIGS. 1 through 7, the spin reduction texture 52 extends about the entire front portion 12 of the ball glove including a front side 58 of the webbing 16. In some implementations, the front portion 12 may have the spin reduction texture 52 applied to any region or any percentage of the front portion 12 and does not have to extend over the entire surface of the front portion. In some implementations, the spin reduction texture 52 may be omitted from those portions of the glove other than the webbing 16. Although FIG. 5 illustrates the backside of webbing 16 as including the same texture as provided on the front side of webbing 16, in some implementations, the backside of webbing 16 may alternatively include other textures different than the texture found on the front side of webbing 16 or may omit any roughened or uneven texture.

Figure 8:
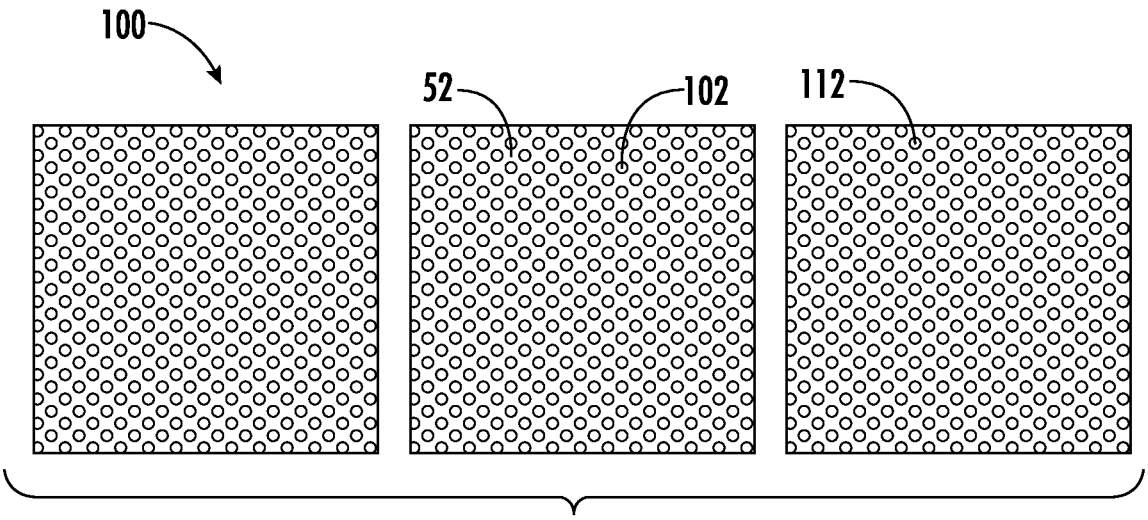
FIG. 8 is top perspective view of a set of three coefficient of friction test skids containing ball glove material including the ball spin reduction technology.
Figure 9:
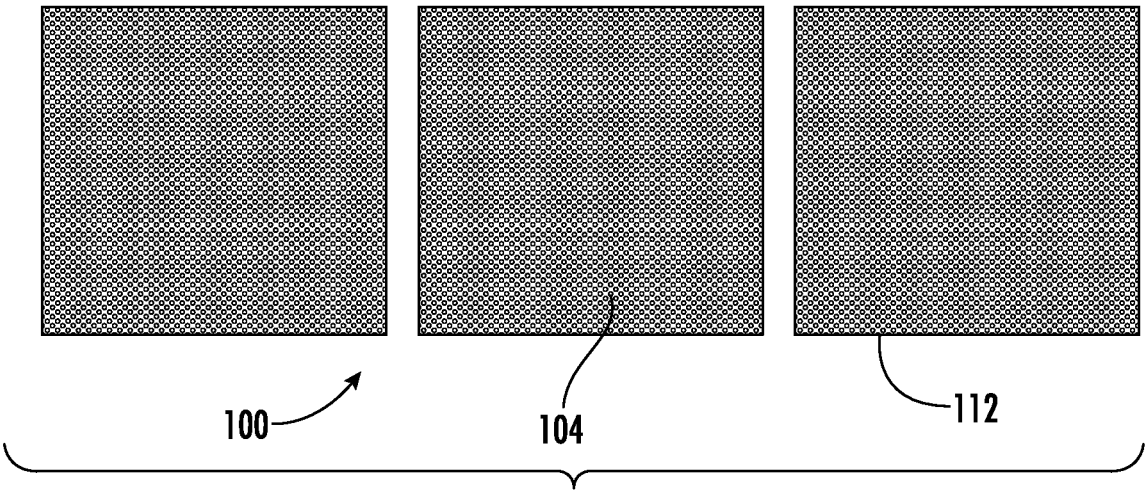
FIG. 9 is top perspective view of a set of three coefficient of friction test skids containing conventional ball glove material.

The increase in the static coefficient of friction of the webbing 16 a ball glove having the spin reduction texture 52 compared to a ball glove webbing without spin reduction texture was measured in a static coefficient of friction test. The static coefficient of friction test was modeled after ASTM Standard D 1894-14 entitled "Standard Test Method for Static and Kinetic Coefficients of Friction of Plastic Film and Sheeting" promulgated by ASTM International located at 100 Barr Harbor Drive, West Conshohocken, Pennsylvania 19428-2959. Referring to FIGS. 8 and 9, the test specimens were prepared from the natural leather used to form the front glove portion of ball gloves. A first set 102 of test specimens 100 shown in FIG. 8 was produced of natural leather that also included the spin reduction texture 52. A second set 104 of the test specimens shown in FIG. 8 was formed without the spin reduction texture.

Figure 10:
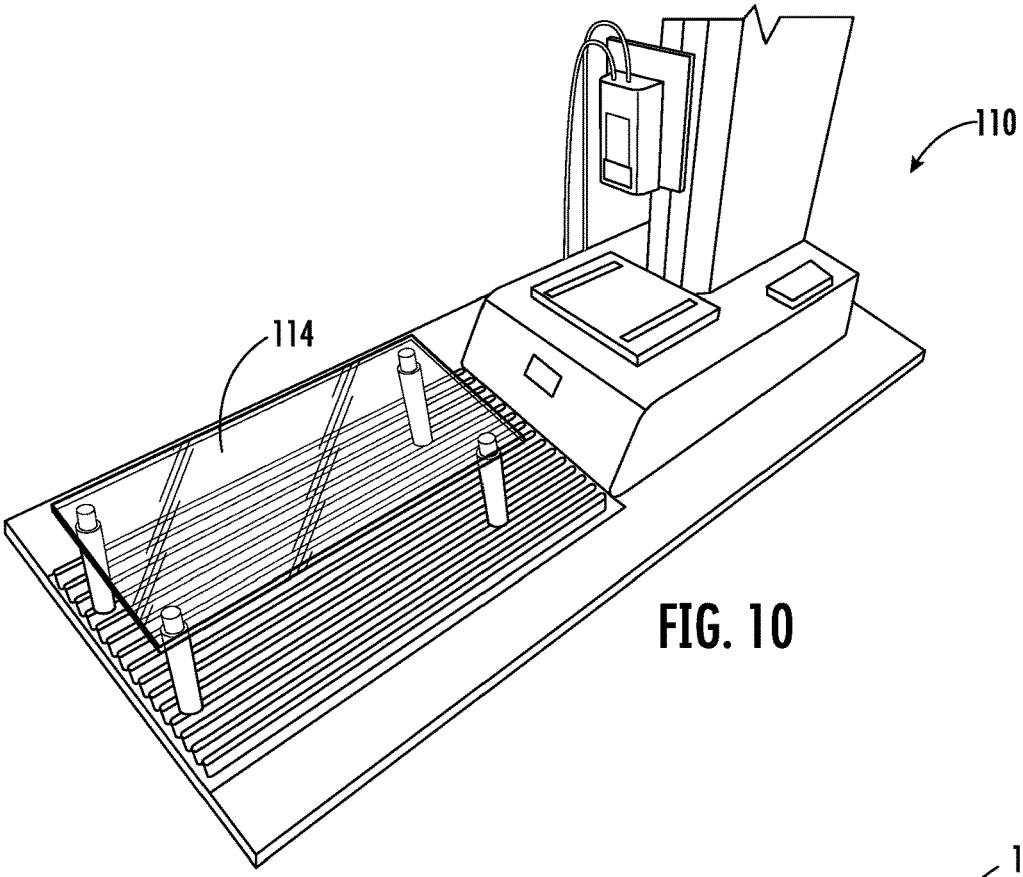
FIGS. 10 through 12 are top, side perspective views of a coefficient of friction test assembly.
Figure 12:
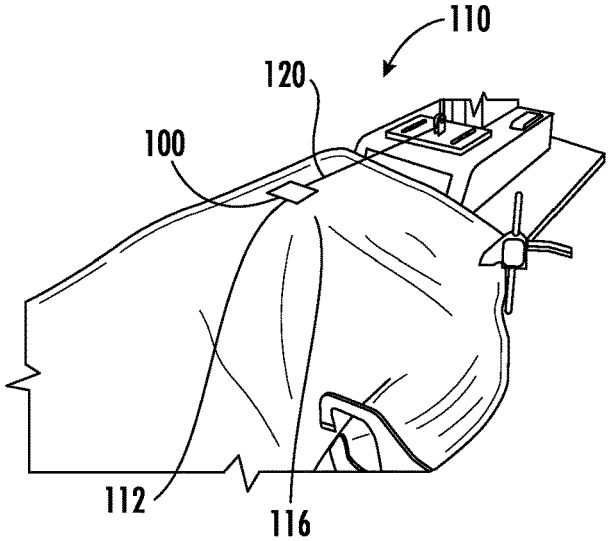
Figure 11:
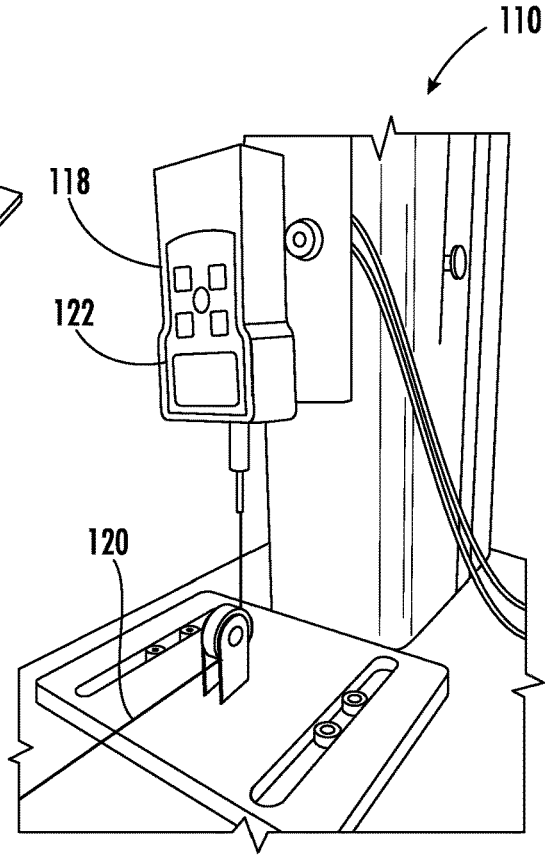

FIGS. 10 through 12 illustrate an example test setup 110 for performing the static coefficient of friction measurement under ASTM Standard D1894. The ASTM Standard D1894 tests the static coefficient of friction of a material (or the test specimen). In an independent test conducted by Assurance Technologies, Inc. (ATI) of Bartlett, Ill., Applicants obtained static coefficient of friction values in accordance with ASTM Standard No. D1894-14, and as described above, for the first set 102 of test specimens that included the spin reduction texture 52 and the second set of test specimens that did not include the spin reduction texture 52. The static coefficient of friction value correlates to the grip-ability or grip quality of the surface being tested. In accordance with ASTM Std. D 1894-14, material samples or specimens are preferably trimmed to 2.5" width×2.5" length (or 2.5 inches by 2.5 inches). A metal sled 112 (see FIGS. 7, 8 and 12) is used having a size of approximately 2.5" length×2.5" width× 0.25" thickness. The bottom of the sled 112 is lined with a high-density foam (having a nominal density of 0.25 g/cm$^3$), and the material specimens are attached to the bottom of sled with for example, a double-faced tape. Prior to testing, the sleds 112 were weighed. A plane or runway 114 formed of glass was used as a supporting base. In this particular test, in order to better measure the interaction between the natural leather ball glove material (with or without the spin reduction texture) a sheet 116 of natural leather used to produce high end baseballs, such as Wilson® A1010™ HS1 Pro Series SST™ baseballs produced by Wilson Sporting Goods Co. of Chicago, Ill., was applied over the glass plane or runway supporting base. The sheet 116 of natural leather used to produce high end baseballs was then pulled taut and clamped to hold it in position.

A total of 6 test skids or sleds 112 with separate test specimens on each sled 112 were prepared. The 6 separate test specimens were obtained from the first and second sets 102 and 104 of test specimens 100. The sleds 112 with the first and second sets 102 and 104 of specimens were pulled by a pulling device 118 and a cord 120 of a fixed length across the sheet 116 on the runway 114 at a speed of 152.4 mm per minute for a total distance of 200 mm. The initial force to start sled movement and the average force from the 25 mm distance to the 175 mm distance is recorded. The pulling device 118 can include a force-measuring device 122 capable of measuring frictional force to +/−5% of its value. The force-measuring device 122 can be a spring gage, a universal testing machine, or a strain gage. In the coefficient of friction test performed by ATI, the force-measuring device 122 was a Shimpo Instruments force measuring gauge, Model Name FGV-XY, with an accuracy of +/−0.2% (well below the 5% range of the ASTM Std.). The sled weight is then divided into the force values (force values divided by the sled weight) to obtain the Static and Kinetic Coefficient of Friction values at the respective sled positions.

The results identified from testing the static coefficient of friction of 6 test specimens 100 discussed above in light of ASTM D1894-14 are shown below in Table 1.

TABLE 1

STATIC COEFFICIENT OF FRICTION

| Sample No | First Set of Test Specimens (Natural Leather for Ball Gloves including Spin Reduction Texture) | Second Set of Test Specimens (Natural Leather for Ball Gloves without Spin Reduction Texture) | % Change COF |
|---|---|---|---|
| 1 | 0.69 | 0.64 | 92.7% |
| 2 | 0.70 | 0.67 | 95.7% |
| 3 | 0.73 | 0.68 | 93.1% |
| Avg. | 0.7066 | 0.6633 | 93.8% |

The static coefficient of friction test results demonstrate an increase in the coefficient of friction values of the first set 102 of specimens 100 that include the spin reduction texture 52 compared to the second set 104 specimens 100 that did not include the spin reduction technology. The measured average static coefficient of friction of the first set 102 of test specimens was more than 5 percent higher than the measured average static coefficient of friction of the second set 104 of test specimens. This measured increase in static coefficient of friction values between the first set 102 of test specimens 100 compared to the second set 104 of test specimens 100 indicates that relative movement of a high-end leather baseball within a ball glove 10 having the spin reduction texture 52 will be less, or more quickly stopped, than relative movement of high-end leather baseball within a ball glove formed without the spin reduction technology. Accordingly, the coefficient of friction values will be increased in a ball glove having spin reduction texture versus a ball glove formed without the spin reduction texture. The increased coefficient of friction will resist movement and/or rotation of a high-end leather baseball within a ball glove to a greater extent than ball gloves formed without the spin reduction texture. Accordingly, the coefficient of friction test results indicate that ball gloves incorporating the spin reduction texture will facilitate a ballplayer's ability to catch, grasp and retrieve a hit, pitched or thrown ball because the spin reduction texture on the front portion of the ball glove will inhibit relative movement of the ball within the ball glove. A spinning hit or thrown ball will stop spinning, rotating or moving within the ballplayer's glove quicker with the spin reduction technology of the present application than a ball glove formed without spin reduction technology. As a result, ball players, such as infielders, can more quickly catch and retrieve the ball from his or her ball glove including the spin reduction texture than a ball glove formed without spin reduction texture. A ballplayer's ability to retrieve a fielded ball quickly from his or her ball glove can be critical in determining the outcome of a baseball or softball play.

Figure 13:
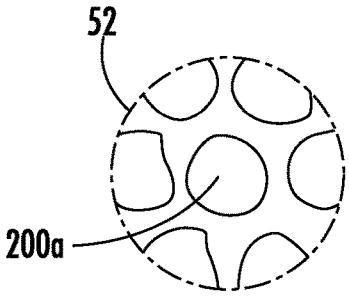
FIGS. 13 through 22 are close-up top views of a first region of a front cover panel of a ball glove having different spin reduction textures including different patterns of raised projection and/or recesses.
Figure 14:
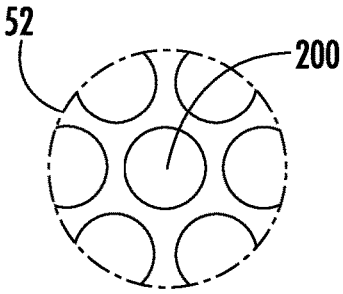
Figure 15:
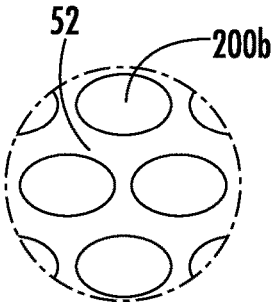
Figure 16:
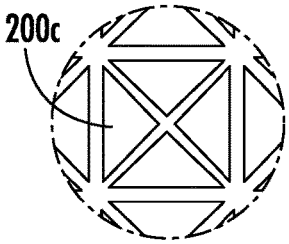
Figure 17:
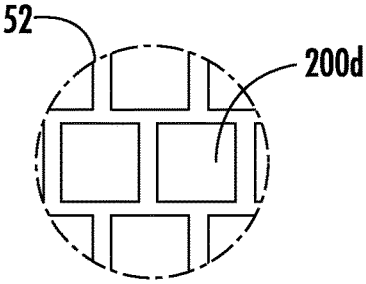
Figure 18:
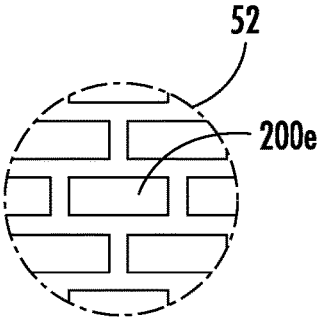
Figure 19:
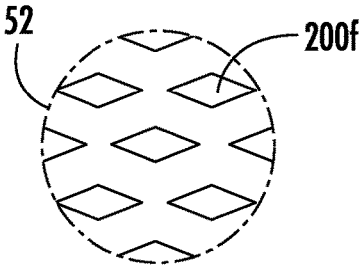
Figure 20:
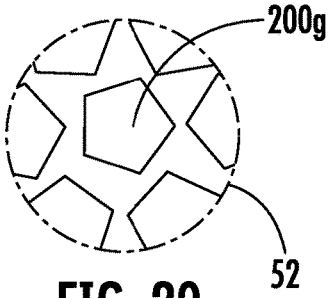
Figure 21:
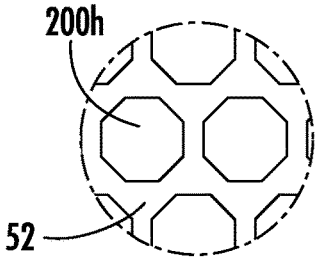
Figure 22:
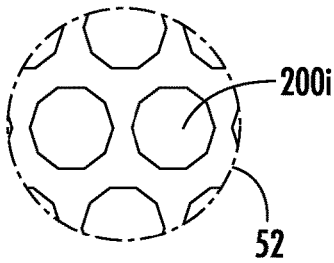

Referring to FIG. 14, a zoomed top view of the spin reduction texture 52 is illustrated. The spin reduction texture 52 can include a first pattern 200 of raised projections and/or recesses. In FIG. 14, the first pattern 200 is a plurality of circular pebble-like recesses. In other implementations, the circular recesses can be circular shaped projections or a combination of circular shaped recesses and/or projections. Referring to FIGS. 13 and 15-22, the first pattern of raised projections and/or recesses 200 can take a variety of different shapes, including, for example, a partially spherical shape, a hemi-spherical shape, a generally oval-shape, a generally polygonal-shape, a frusto-conical shape, a conical shape, a pyramid shape, a cylindrical shape, a truncated pyramid shape, a cubic shape, other irregular-shapes, and combinations thereof. Referring to FIG. 13, pebble-like recesses or projections 200*a* can have an irregular rounded shape. Referring to FIG. 15, pebble-like recesses or projections 200*b* can have an oval or elliptical shape. Referring to FIG. 16, pebble-like recesses or projections 200*c* can have a triangular shape. Referring to FIG. 17, pebble-like recesses or projections 200*d* can have a triangular shape. Referring to FIG. 18, pebble-like recesses or projections 200*e* can have a triangular shape. Referring to FIG. 19, pebble-like recesses or projections 200*f* can have a triangular shape. Referring to FIGS. 20 through 22 in other implementations, the pebble-like projections can take other polygonal shapes, such as, for example, a pebble-like recess or projection 200*g* can have a pentagonal shape, a pebble-like recess or projection 200*h* can have a hexagonal shape, and a pebble-like projection 200*i* can have an octagonal shape. In other implementations, combinations of the pebble-like recesses or projections 200*a* through 200*i* can be used.

Figure 23:
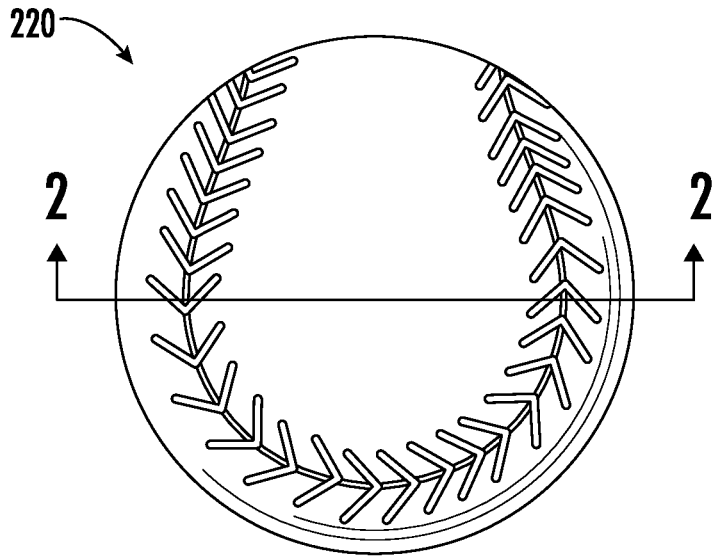
FIG. 23 is a front view of a baseball in accordance with one implementation.
Figure 24:
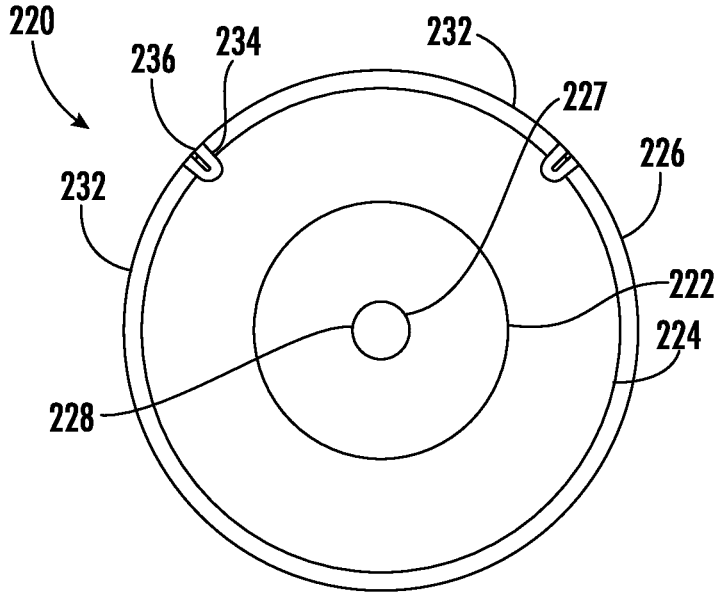
FIG. 24 is a cross-sectional view of the baseball of FIG. 23.

A ball carrying a sensor can also be used to measure the advantages of the spin reduction texture 52 on the front or palm portion 12 of the ball glove 10. The sensored or smart ball can be used in conjunction with the ball glove 10 or with a set of ball gloves (with some ball gloves incorporating the present invention, and others being existing ball gloves without the spin reduction technology or texture). The sensored or smart ball can be a baseball, a fast pitch softball or a slow pitch softball. As shown by FIGS. 23 and 24, a baseball 220 comprises a core 222, at least one layer of yarn 224, a cover assembly 226 and electronics 228. Although a baseball is illustrated the electronics and features described below are also applicable to a fastpitch softball or a softball used for slow pitch softball. The core 222, also referred to as a pill, comprises a sphere forming a center portion of the ball 220. In one implementation, the core 222 comprises a cork material. In another implementation, the core 222 comprises an elastomeric or rubber material. In one implementation, the core 222 comprises a cork center portion encased are surrounded by one or more layers of rubber materials. Example of rubber materials include, but are not limited to, non-diene-based rubber materials and diene-based rubber materials such as a polybutadiene rubber. In yet other embodiments, the core 222 may be formed from other materials.

In one implementation, the core 222 is formed as a solid, homogeneous, one-piece spherical body. In another implementation, the core 222 can be formed from two or more layers of materials, such as two or more rubber compositions.

The at least one layer of yarn 224 surrounds the core 122. The yarn 224 comprise at least one layer single or multiply yarn windings. Such yarn windings may be single ply, five ply, three ply or other numbers of ply values or combinations. The yarn windings may be formed of wool, synthetic yarn, synthetic recycled fibers (such as from used carpet), and fibers or combinations thereof. Synthetic yarn may be formed from polyester, rayon, acrylic, other synthetic materials and combinations thereof. In one implementation, the at least one layer of yarn 224 comprises five ply yarn windings, wherein the yarn can be 85% wool and 15% synthetic fibers. In other implementations, other combinations percentages of wool and synthetic fibers may be employed.

The cover assembly 226 comprises one or more panels surrounding the at least one yarn layer 224 and providing an outer cover to the ball 220. In the example illustrated, cover assembly 226 comprises two cover panels 232 connected to one another by a stitching 234 along at least one seam 236. The seam 236 is generally flush with the outer diameter the ball 220. In other implementations, one seam 236 may be raised slightly raised with respect to central regions of panels 232. The seam 236 may be formed by abutted, overlapped, curved or inverted edges of the cover panels 232. The stitching 234 joining the panels 232 along the seam 236 is formed from a high tensile strength thread, such as Kevlar thread material. In other implementations, other high tensile strength thread materials may be utilized.

The panels 232 comprise panels formed from a durable high-strength material, such as natural leather. In other implementations, the panel 232 may be formed from other durable material such as split leather, synthetic leather, polyurethane, a polyvinyl chloride (PVC), other polymeric materials, or combinations thereof. Although the panels 232 are illustrated as each having the same shape, in other implementations, panel 232 may have dissimilar shapes with respect to one another. In other implementations, the ball 220 may utilize more than two panels 232.

In one implementation, ball has an initial compression value obtained in accordance with ASTM Standard Test Method F1888-09 and a second compression value obtained in accordance with ASTM Standard Test Method F1888-09 after the baseball has undergone at least 60 impacts of approximately 60 mph against a strike plate, the second compression value being greater than 75% of the initial compression value. In one implementation, the core 222 has a diameter of less than 2 inches. In one implementation, the ball 220 has a circumference of less than 12.5 inches. In one implementation, the ball 220 has a circumference of less than 12 inches. In another implementation, the ball 220 has a circumference greater than 9.5 inches, such as a softball. In other implementations, the ball 220 has a circumference of less than or equal to 9.5 inches any weight of less than 5.5 ounces, such as a baseball. In other implementations, the ball 220, but for the electronics 228, may have other configurations.

The electronics 228 are carried by the ball 220 and perform one or more functions based upon sensed motion or travel of the ball 220. In the example illustrated, the electronics 228 are located inwardly of cover panels 232. In the example illustrated, the electronics 228 are located inwardly of the at least one layer of yarn 224. In the example illustrated, the electronics 228 are located at least partially within the core 222. In the specific example illustrated, the electronics 228 are located at a center point or centered portion of the ball 220 within the core 222. In one implementation, the electronics 228 are encapsulated within materials of the core 222. In another implementation, the electronics 228 are located within cavity 227 within the core 222. Because the electronics 228 are centered within the ball 220, the electronics 228 are less likely to impact weight distribution characteristics and the feel of the ball 220.

In other implementations, the electronics 228 may located at other locations, such as: in an un-centered, eccentric position within the core 222; in a cavity or depression extending from an exterior surface of the core 222 into the core 222; centrally located within the one or more windings of the one or more of layers of yarn 224; in a cavity or depression extending from an exterior surface of the at least one layer of yarn 224 into the at least one layer of yarn 224; and/or in a cavity or void formed between the core 222 and yarn layer(s) 224 are between yarn layer(s) 224 and cover panels 232.

Figure 2:
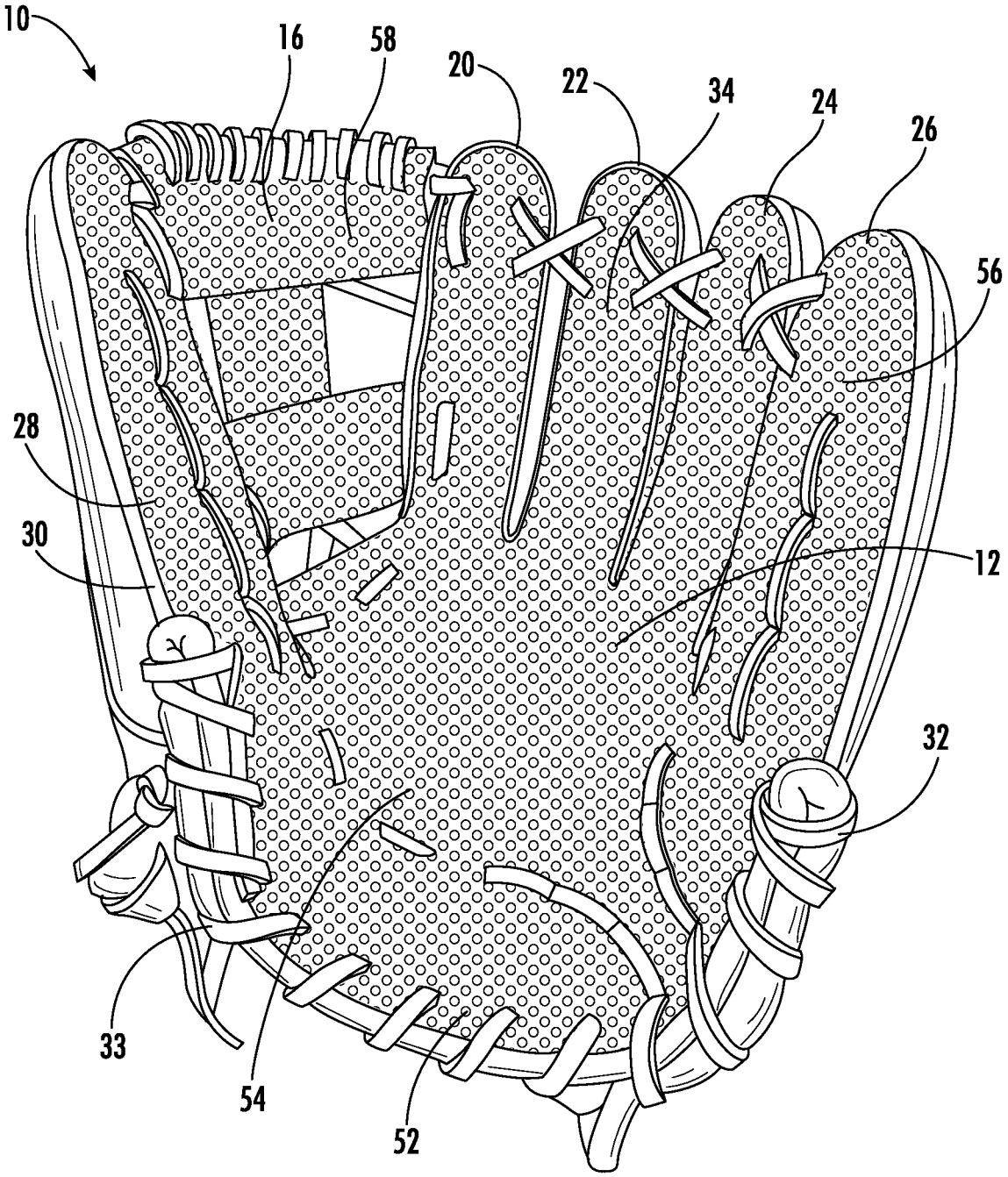
FIG. 2 is another palm or front side perspective view of the ball glove of FIG. 1.
Figure 3:
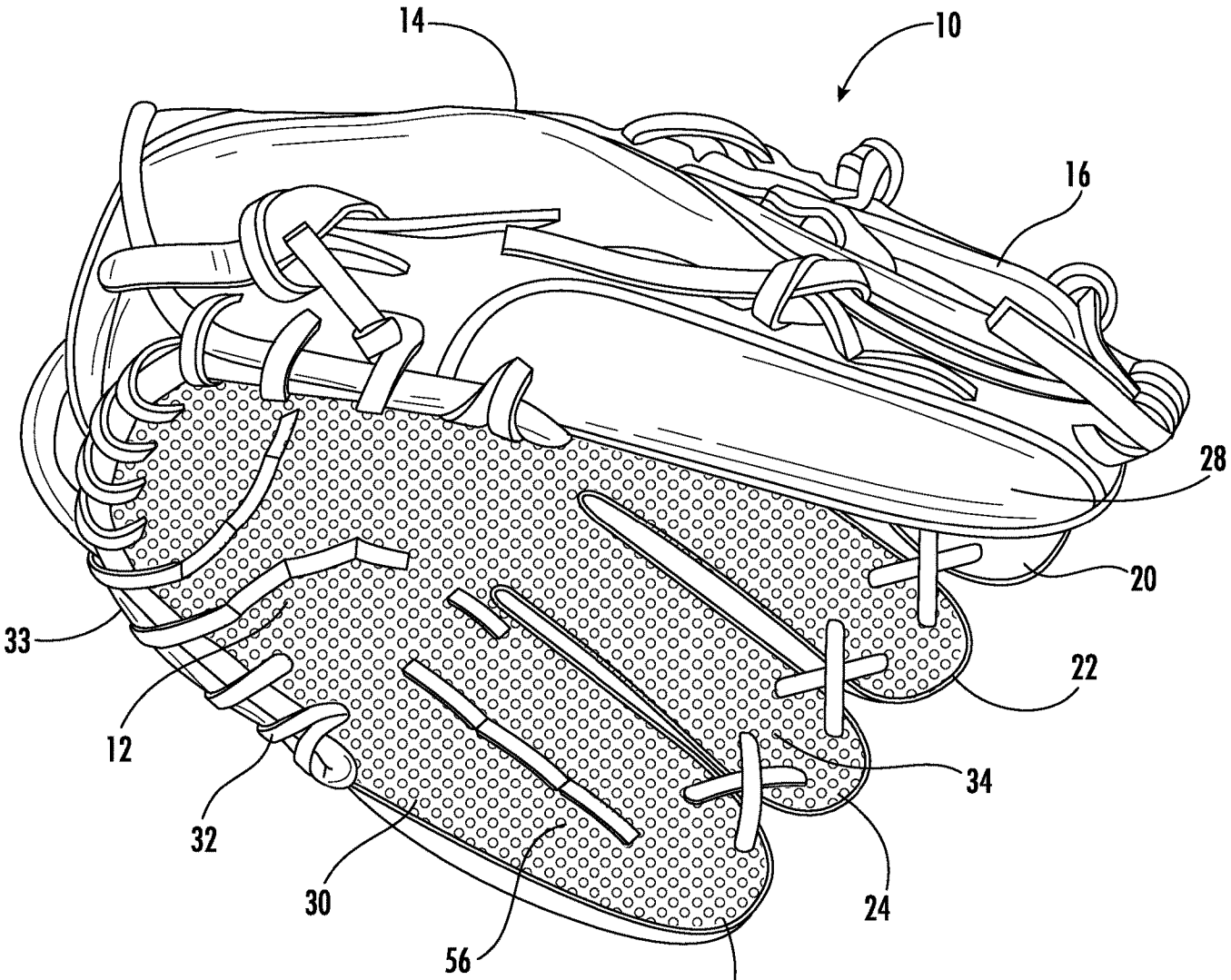
FIG. 3 is a left side perspective view of the ball glove of FIG. 1.
Figure 4:
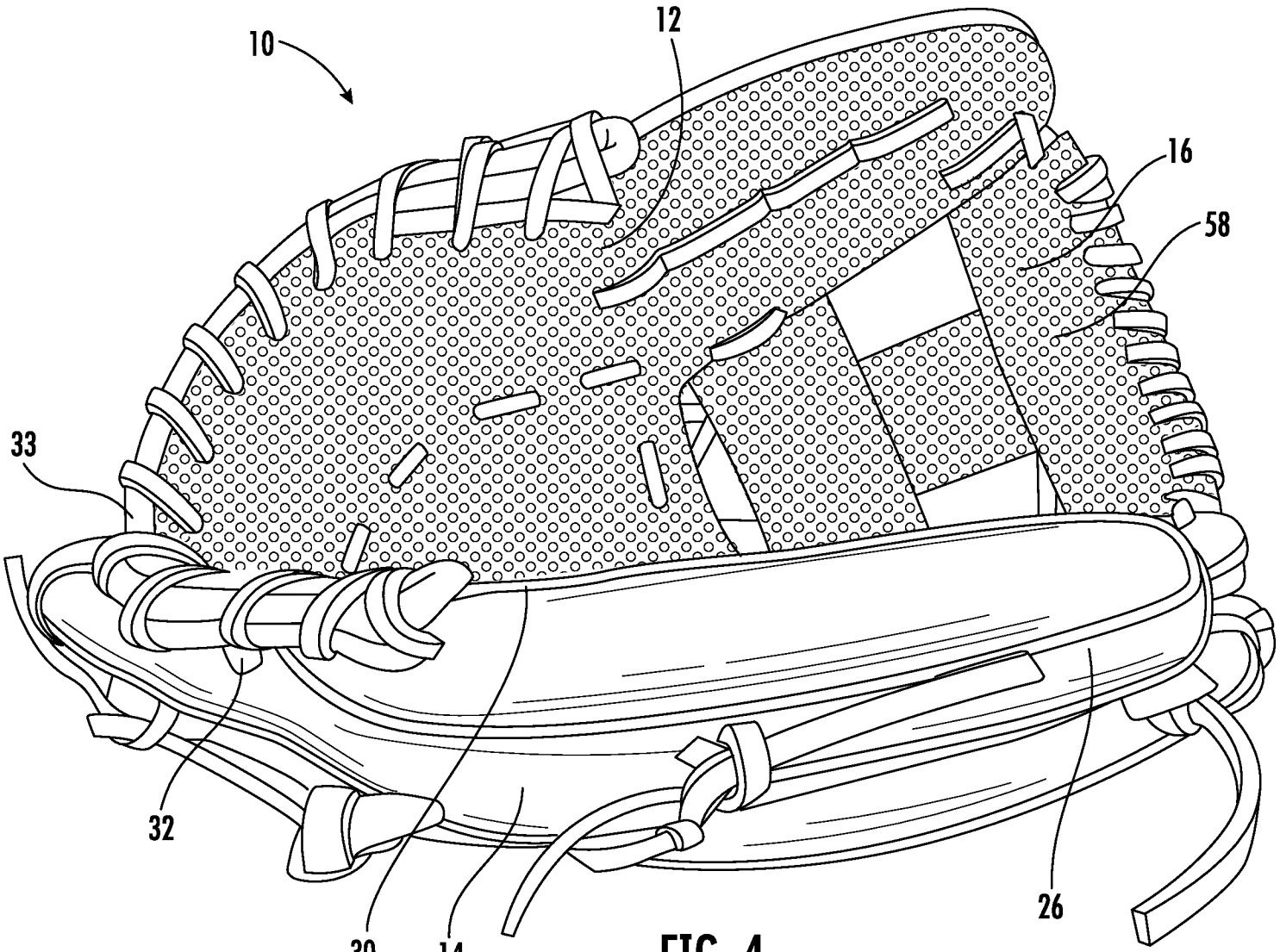
FIG. 4 is a right-side perspective view of the ball glove of FIG. 1.
Figure 25:
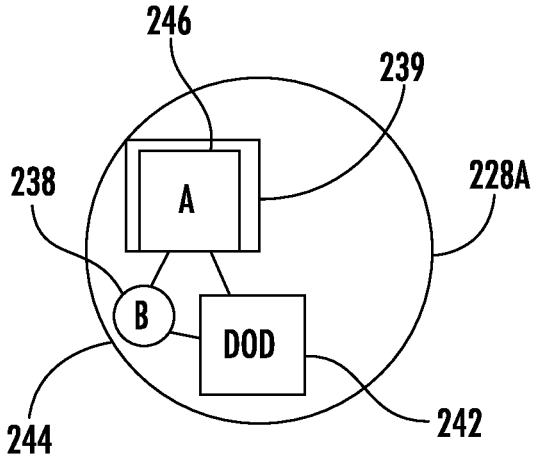
FIG. 25 is a schematic representation of one implementation of electronics within the baseball of FIG. 24.

FIG. 25 illustrates electronics 228A, one example of electronics 228 shown in FIG. 2. Electronics 228A are carried by the ball 220 and perform one or more functions based upon sensed motion or travel of the ball 220. Electronics 228A comprise a battery 238, motion sensor 239 and a data output device 242. Although the components of electronics 228 are illustrated as being housed or contained within a spherical body 244, in other implementations, the components of electronics 228A may be supported or contained in other manners, such as along a substrate or circuit chip or the like.

Battery 238 comprises a power storage device to store power for use by sensor 240 and data output device 242. In one implementation, battery 238 comprises a one-use battery. In another implementation, battery 238 comprises a rechargeable battery. For example, in one implementation, battery 238 is rechargeable in a wired fashion through a plug or port in the ball 220. In another implementation, battery 238 is rechargeable in a noncontact fashion. In one implementation, battery 238 may be inductively charged or recharged. In one implementation, the ball 220 is alternatively configured to provide access to battery 238 for removal and replacement of battery 238.

Motion sensor 239 comprises one or more sensors to sense motion of the ball 220 facilitating a determination of a speed, travel velocity or linear velocity of the ball 220. Motion sensor 239 facilitates feedback regarding the speed of the ball 220. Motion sensor 239 provides raw sensed motion data in the form of sensed acceleration along different axes. For purposes of this disclosure, the term "raw sensed motion data" comprises data or signals directly outputted or determined by sensor 240. For purposes of this disclosure, the term "sensed motion data" or "motion data" encompasses at least one of raw sensed motion data and data that has been generated based upon or using the raw sensed motion data, such as data that has been derived from the raw sensed motion data. By sensing parameters from which the travel speed of the ball 220 may be identified or determined, the ball 220 provides feedback for evaluation of a hit, thrown or pitched ball. In one implementation, motion sensor 239 comprises one or more accelerometers 246, which provide acceleration signals or data from which the speed of the ball 220 is determined. By allowing the speed of the ball 220 to be determined, sensor 240 facilitates evaluation of a hit ball or of a pitch, such as a fastball pitch and a changeup pitch.

Data output device 242 comprises one or more devices to externally communicate the motion information or motion data sensed by sensor 240. In one implementation, data output device 242 comprises a device to wirelessly transmit signals representing the sensed motion information. For example, in one implementation, data output device 242 comprises a Bluetooth device. In another implementation, data output device 242 comprises a Wi-Fi or other radiofrequency transmitter. In another implementation, data output device 242 comprises an active read/write RFID tag, which is written upon with data sensed by sensor 240, wherein device 242 actively transmits signals from the tag. In yet another implementation, data output device 242 comprises a passive read/write RFID tag, which is written upon with data sent by sensor 240, wherein device 242 is passively read by an external radiofrequency device reader. In another implementation, data output device 242 comprises an infrared or other optical communication device. In yet other implementations, data output device 242 may comprise other devices that communicate the sensed motion data to recipients external to the ball 220 in a wireless fashion.

In one implementation, the ball 220 communicates the sensed motion data to recipient(s) external to the ball 220 in a wireless fashion, wherein the external recipient comprises a portable electronic device such as a smart phone, a flash memory reader (IPOD), a cell phone, a personal data assistant, a laptop computer, a tablet or netbook computer and the like. In one implementation, electronics 228A carries out at least some data modifications and/or analysis prior to the data being externally transmitted to the portable electronic device. For example, electronics 228A may carry out some analysis, data derivations or data compression on the sensed motion information or on derived results of the sensed motion information prior to transmitting the modified, derived and/or compressed data to the portable electronic device. In other implementations, electronics 228A may transmit, in real time, raw signal data or raw sensed motion data directly from sensor 240 to the portable electronic device, wherein the portable electronic device performs analysis or further data derivation using the raw sensed motion data. In such an implementation, because the processing power is more greatly provided by the portable electronic device, rather than electronics 228A of the ball 220, the cost of the ball 220 may be kept low.

As will be described hereafter with respect to other figures, in some implementations, data output device 242 may additionally or alternatively communicate the sensed motion data in other fashions. For example, in one implementation, data output device 242 comprises a plug-in or port by which the sensed motion data may be communicated externally from the ball 220 in a wired fashion.

Figure 26:
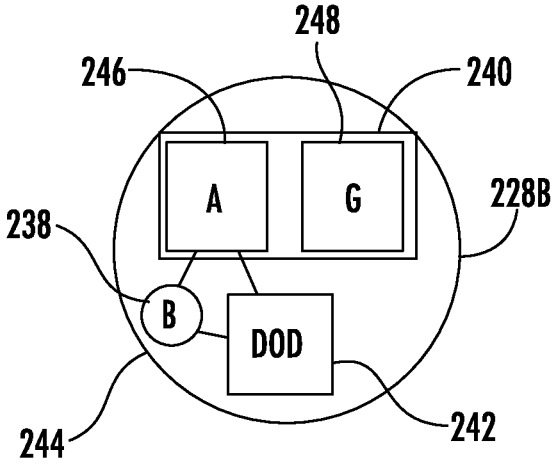
FIG. 26 is a schematic representation of another implementation of electronics within the baseball of FIG. 24.

FIG. 26 illustrates electronics 228B, another implementation of electronics 28 in the ball 220. Electronics 228B is similar to electronics 228A except that electronics 228B comprises sensor 240 in lieu of sensor 239. Sensor 240 is similar to sensor 239 except that sensor 240 is additionally configured to sense or detect a spin axis about which the ball 220 is spinning or rotating and a rate at which the ball 220 is spinning or rotating about the spin axis. As a result, in addition to being able to detect parameters from which linear velocity of the ball 220 may be determined, sensor 240 also detects parameters or values indicating angular velocity and acceleration which are indicative of "action" or ball movement of a hit ball, a thrown ball or a pitch.

Figure 27:
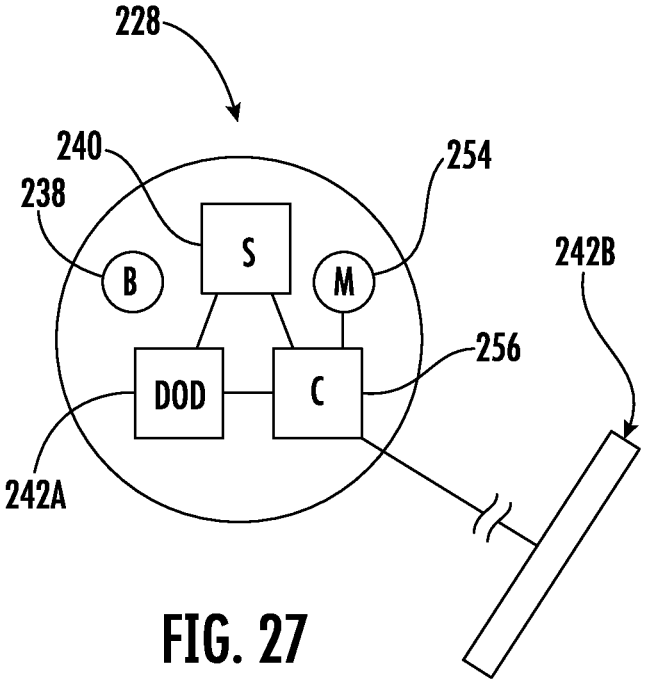
FIG. 27 is a schematic representation of another implementation of electronics within the baseball of FIG. 24.
Figure 28:
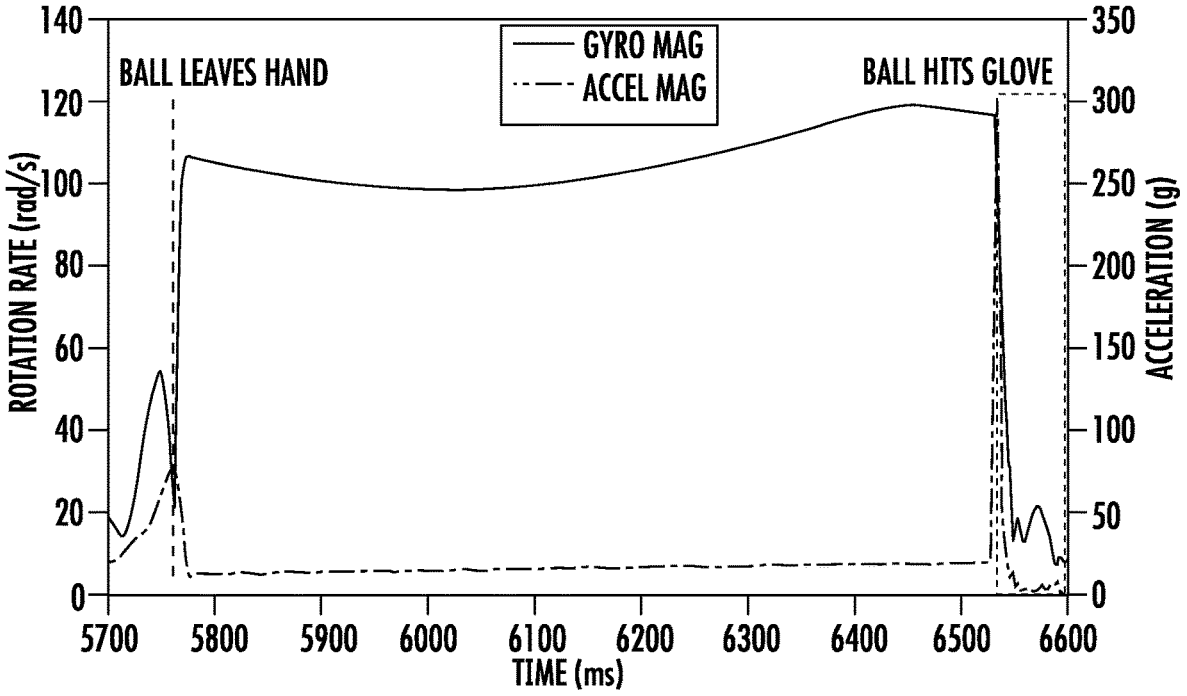
FIG. 28 is a graph illustrating a sensed acceleration and rotation of a smart baseball during a throw and catch of the baseball.

Referring to FIGS. 26 through 28, by detecting the spin axis as well as a spin rate, or parameters corresponding to the spin axis and spin rate, sensor 240 provides feedback for evaluation of different throws or pitches. The sensor can provide signals indicating the reduction in spin rate of the ball 220 as it enters the ball glove 10. Therefore, the sensor 240 in the ball 220 can be used to determine the spin rate reduction of balls 220 entering the ball glove 20 having the spin reduction texture 52 compared to ball gloves produced without the spin reduction texture. Because sensor 240 provide signals indicating a spin axis of a particular hit, pitched or thrown ball, sensor 240 enables controller 256 (FIG. 27) to identify or determine what type of pitch is being thrown. The sensor 240 can also be configured to identify the angle of the spin axis with respect to a reference, such as the ground or polar axes. Different types of pitches, such as four and two seam (a.k.a. sinker) fastballs, cutter (cut fastball), splitter (split finger fastball), forkball, curveball, slider, sinker, a slider, slurve, screwball, changeup, palm-ball and circle changeup pitches, may have different signature characteristic spin axes or ranges of spin axes.

Although sensor 240 is illustrated as comprising one or more accelerometers 246 and one or more angular rate gyros or gyrometers 248, in other implementations, sensor 240 may additionally or alternatively comprise a temperature sensor, a pressure sensor and/or a magnetometer. In some implementations, sensor 240 may additionally or alternatively comprise a global positioning system (GPS) antenna or sensor.

Memory 254 comprises one or more non-transient computer-readable medium or persistent storage devices carried within ball 220 and accessed for reading and/or writing by controller 256 and data output device 242A and/or data output device 242B. In one implementation, memory 254 includes computer-readable instructions or code for directing the operation of controller 256. In one implementation, memory 254 additionally or alternatively stores sensed motion data. The sensed motion data stored by memory 254 comprises both the raw sensed motion data and sensed motion data that has been derived from the raw sensed motion data.

FIG. 28 is a graph illustrating the sensed acceleration and rotation of a Diamond Kinetics® Pitchtracker™ smart baseball produced by Diamond Kinetics, Inc. of Pittsburgh, Pa. during a throw and catch of the baseball. The Pitchtracker™ smart baseball captures data in real time and provides in-depth analysis of baseball core measurements including release velocity, acceleration and rotation (spin rate). As shown by FIG. 28, from the time that the baseball leaves a thrower's hand to the time that the baseball hits a recipient's glove, both the acceleration and the rotation remain relatively constant. Following impact with the recipient's glove, the acceleration drastically declines. The spin rotation of the baseball also declines, but at a slower rate.

Figure 29:
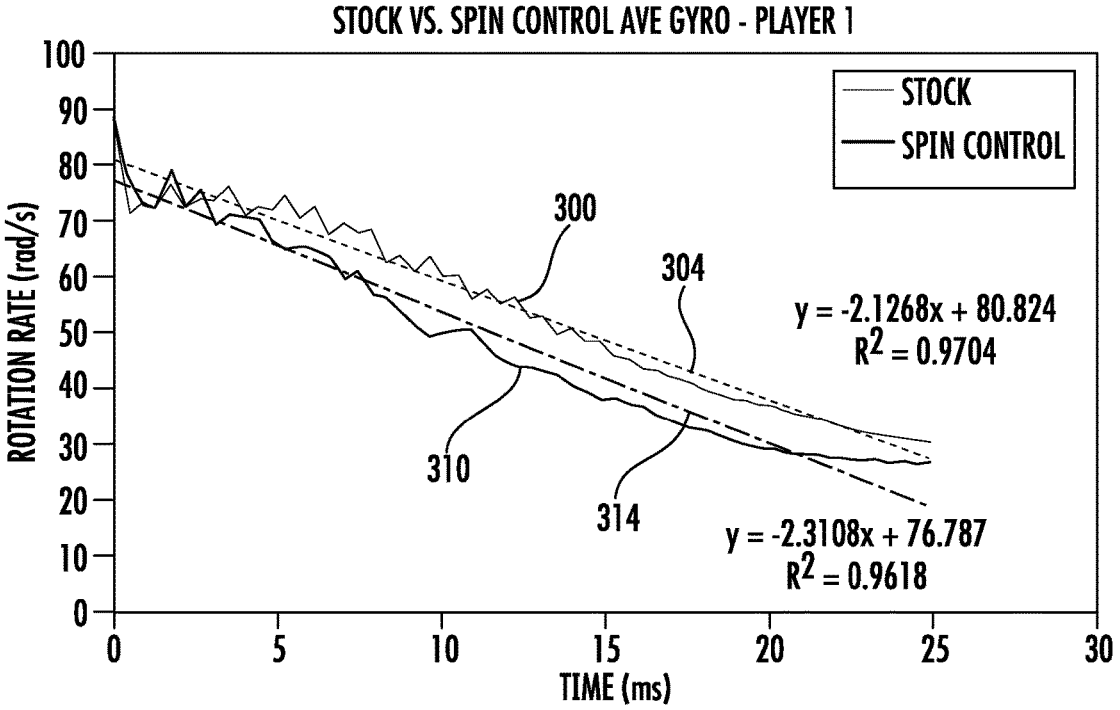
FIG. 29 is a graph comparing a first set of data indicating the sensed rate at which spin of the baseball declines (angular deceleration) following impact with a stock glove to a second set of data indicating the sensed rate at which spin of the baseball declines following impact with the glove of FIGS. 1-7.
Figure 30:
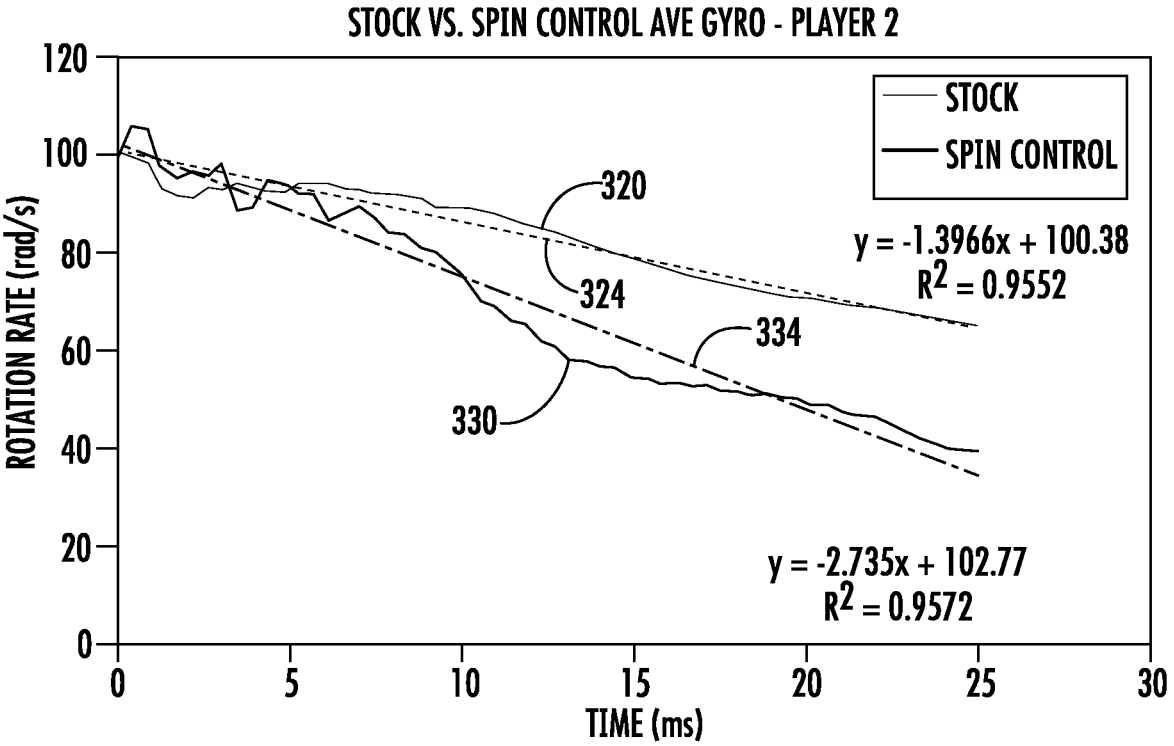
FIG. 30 is a graph comparing a third set of data indicating the sensed rate at which spin of the baseball declines (angular deceleration) following impact with a stock glove to a fourth set of data indicating the sensed rate at which spin of the baseball declines following impact with the glove of FIGS. 1-7.

FIGS. 29 and 30 are graphs comparing the sensed rate at which spin of the baseball declines (angular deceleration) following impact with a stock glove (formed without a spin reduction texture) and the sensed rate at which spin of the baseball declines following impact with a glove having a spin reduction texture on the front portion 12 of the ball glove 10 including the webbing 16 as shown in FIG. 1. A baseball player (Player 1) and a softball player (Player 2) stood approximately 40 feet apart and threw the Pitchtracker™ smart baseball between each other at velocities of between 50 to 60 mph. Line 300 in FIG. 29 illustrates data acquired from ball 220 being thrown by the softball player and caught by the baseball player (Player 1) twenty-one (21) times using a stock glove, a Wilson® A2000® infielder's glove. The linear regression 304 of line 300 is represented by the function $y=-2.1268x+80.824$ (with an R2 of 0.9704), where Y is rotational radial spin in radians per second and where x is the time in milliseconds from the moment of impact with the glove. In this example, the angular rotation or spinning of the baseball is reduced by approximately 496 rpm over a 25 ms interval following initial impact of the ball with the stock ball glove.

Line 310 in FIG. 29 illustrates data acquired from ball 220 being thrown by the softball player and caught by the baseball player (Player 1) twenty-one (21) times using ball glove 10 that includes the spin reduction texture 52. The linear regression 314 of line 310 is represented by the function $y=-2.3108x+76.787$ (with an R2 of 0.9618), where Y is rotational radar spin in radians per second and where x is the time in milliseconds from the moment of impact with the glove. In this example, the angular rotation or spinning of the baseball is reduced by approximately 544 rpm over a 25 ms interval following initial impact of the ball with the ball glove having the spin reduction texture 52 (when acceleration of the ball drastically declines, or decelerates, as shown in FIG. 28). As shown by FIG. 29, the ball 228 being caught by ball glove 10 experienced a spin deceleration (or angular deceleration) over a 25 ms interval from the moment of impact with the glove that is 8% greater than the spin deceleration of the same ball 220 being caught by the stock glove. In other words, the slope of the linear regression line of the data acquired from the glove with the spin reduction texture 52 is 8 percent lower than the slope of the linear regression line of the data acquired from the stock ball glove formed without the spin reduction texture 52.

Line 320 in FIG. 30 illustrates data acquired from ball 220 being thrown by the baseball player (Player 1) and caught by the softball player (Player 2) twenty-one (21) times using a stock glove, a Wilson® A2000® infielder's glove. The linear regression 324 of line 320 is represented by the function $y=-1.3966+100.38$ (with an R2 of 0.9552), where Y is rotational radar spin in radians per second and where x is the time in milliseconds from the moment of impact with the glove. In this illustrated example, the angular rotation or spinning of the baseball is reduced by approximately 363 rpm over a 25 ms interval following initial impact of the ball with the stock ball glove.

Line 330 in FIG. 30 illustrates data acquired from ball 220 being thrown by the baseball player (Player 1) and caught by the softball player (Player 2) twenty-one (21) times using ball glove 10. The linear regression 334 of line 330 is represented by the function y=−2.735x+102.77 (with an R2 of 0.9572), where Y is rotational radar spin in radians per second and where x is the time in milliseconds from the moment of impact with the glove. In this example, the angular rotation or spinning of the baseball is reduced by approximately 630 rpm over a 25 ms interval following initial impact of the ball with the ball glove having the spin reduction texture 52. As shown by FIG. 30, the ball 228 being caught by ball glove 10 experienced a spin deceleration (or angular deceleration) of over 48% greater than the spin deceleration of the same ball 220 being caught by the stock glove. In other words, the slope of the linear regression line of the data acquired from the glove with the spin reduction texture 52 is over 48 percent lower than the slope of the linear regression line of the data acquired from the stock ball glove formed without the spin reduction texture 52.

Figure 31:
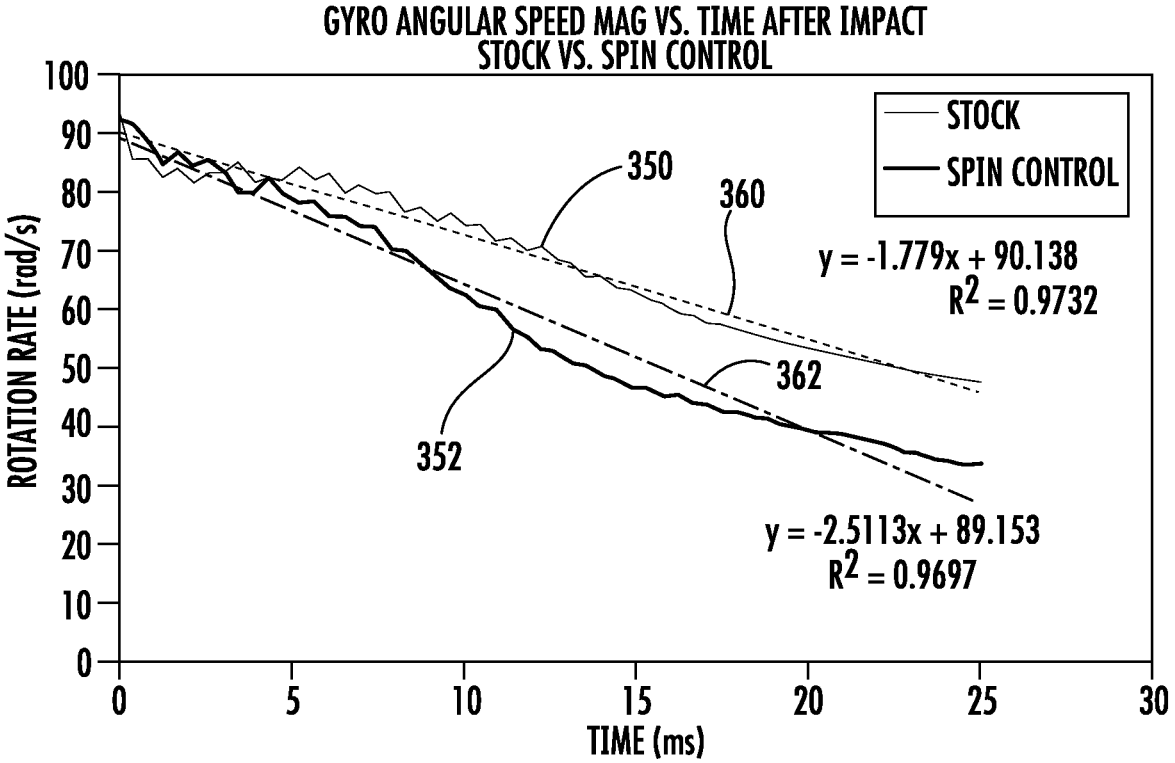
FIG. 31 is a graph comparing averages of the first and third sets of data to averages of the second and fourth sets of data.

Lines 350 and 352 in FIG. 31 illustrate the combination of the data presented by 29 and 30. The linear regression 360 of line 350 is represented by the function y=−1.779x+90.138 (with an $R^2$ of 0.9732), where y is the rotational rate or spin in radians per second and where x is the time in milliseconds from the moment of impact with the glove (corresponding to acceleration drop). In this example, the angular rotation or spinning of the baseball is reduced by approximately 410 rpm over a 25 ms interval following initial impact of the ball with the stock ball glove. The linear regression line 362 of line 360 is represented by the function y=−2.5113x+89.153 (with an $R^2$ of 0.9697), where Y is rotational radar spin in radians per second and where x is the time in milliseconds from the moment of impact with the glove. In this example, the spin reduction texture 52 reduces the angular rotation or spinning of the baseball by approximately 582 rpm over a 25 ms interval following initial impact of the ball with the ball glove 10. As shown by FIG. 31, the ball 228 being caught by ball glove 10 with the spin reduction texture 52 experienced a spin deceleration (or angular deceleration) of over 29% greater than the spin deceleration of the same ball 220 being caught by the stock glove. In other words, the slope of the linear regression line of the data acquired from the glove with the spin reduction texture 52 is over 29 percent lower than the slope of the linear regression line of the data acquired from the stock ball glove formed without the spin reduction texture 52.

The slopes of the linear regression lines of the data acquired from the baseballs caught from the glove with the spin reduction texture 52 from Player 1, Player 2 and the combination of Players 1 and 2 were −2.3108, −2.735, and −2.5113, respectively. Further, the reduction in the angular rotation or spinning of the baseball when caught with the ball glove having the spin reduction texture 52 was approximately 544 rpm, 630 rpm and 582 rpm over a 25 ms interval following initial impact of the ball with the ball glove. Conversely, the reduction in the angular rotation or spinning of the baseball when caught with the stock ball glove not having the spin reduction texture 52 was approximately 496 rpm, 363 rpm and 410 rpm over 25 ms intervals following initial impact of the ball with the ball glove. Accordingly, the ball glove having the spin reduction texture 52 produced a reduction in the angular rotation or spinning of the baseball of at least 540 rpm over a 25 ms interval following initial impact of the ball with the ball glove, when the ball was thrown at a velocity of within the range of 50-60 mph. Additionally, the ball glove having the spin reduction texture 52 produces a linear regression line having a slope of at least −2.3 from data acquired from catching baseballs thrown at a speed within the range of 50-60 mph. As a result, the sample testing indicates that glove 10 and other gloves provided with a spin reducing texture can more quickly reduce the spin of the ball in the glove, enhancing a ballplayer's ability to catch or field, grasp and retrieve a pitched, thrown or hit ball from the ball glove. By inhibiting or reducing the ball's spin upon fielding or catching a ball, the spin reducing texture of the ball glove can make the fielded ball easier to grasp and retrieve from the ball glove.

Figure 32:
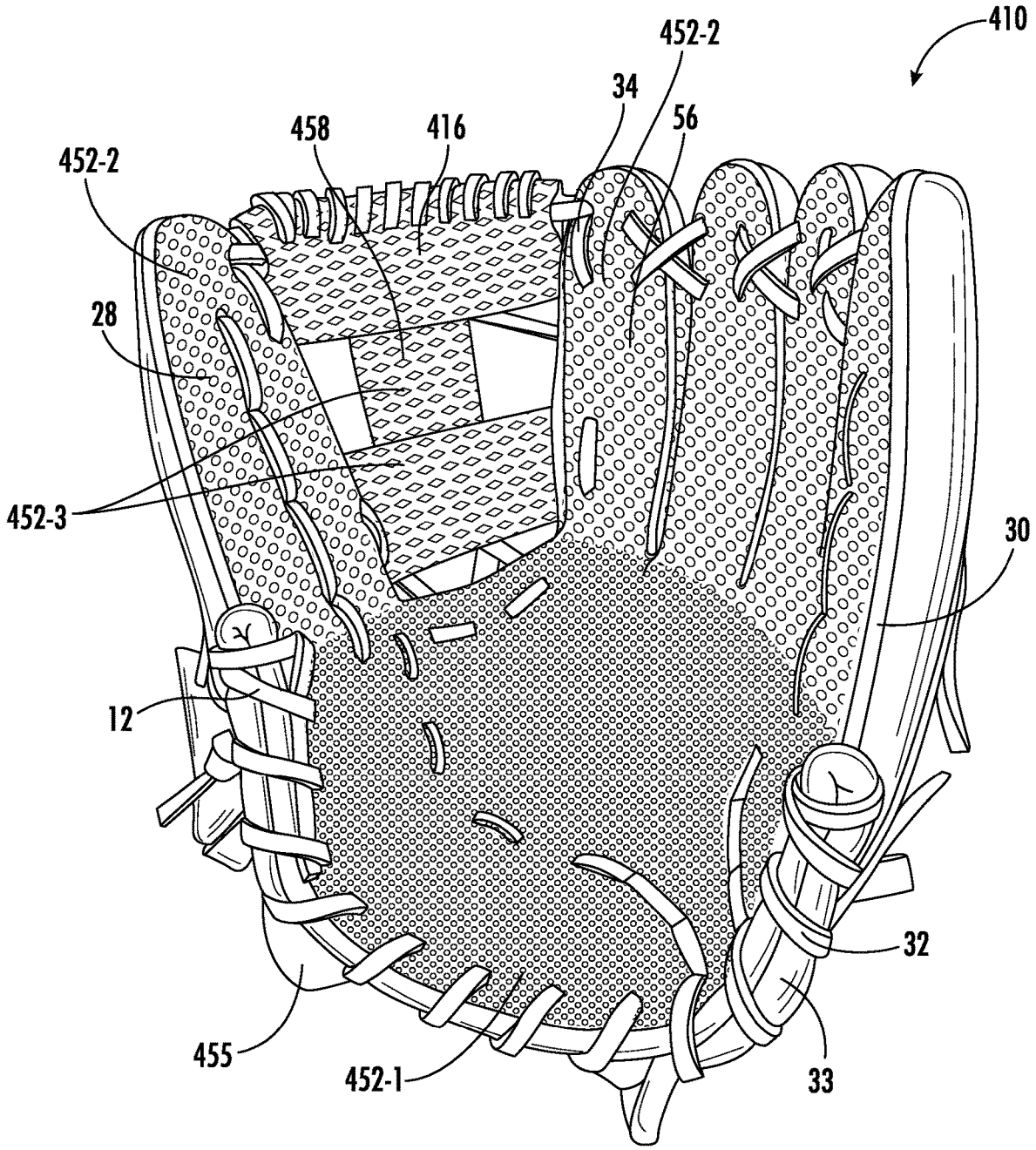
FIG. 32 is a palm or front side perspective view of an example ball glove in accordance with one implementation.
Figure 33:
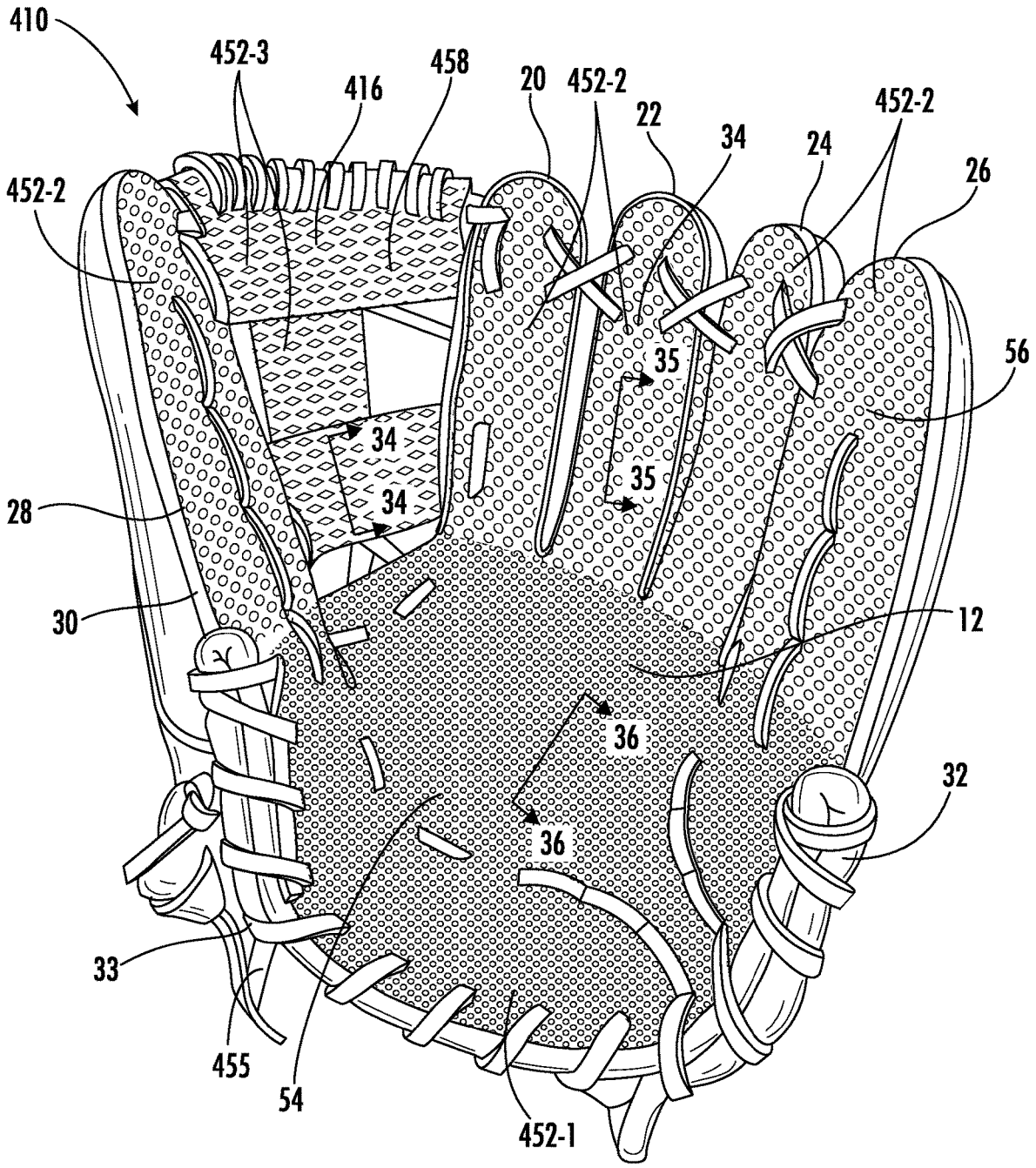
FIG. 33 is a palm or front side perspective view of the ball glove in accordance with one implementation.

FIGS. 32 and 33 illustrate an example ball glove 410 provided with a plurality of different spin reducing textures for enhanced spin reduction and ball release. Different portions of the palm side of a ball glove may differently interact with a caught or fielded baseball. For example, some portions may have a greater impact on reducing the spin of the ball than others the example ball glove 410 comprises different portions of the palm side of a baseball glove with different spin reducing textures to enhance spin reduction and or to provide greater feel or easier removal of the ball from the glove. The example ball glove 410 comprises a first portion of the ball glove with a first spin reduction texture that offers a higher degree of friction, such as a deeper pattern of raised projections and/or recesses, and provide a second different portion of the ball glove with a second spin reduction texture that has a lower degree of friction, such as a shallower pattern of raised projections and/or recesses.

In the example illustrated, ball glove 410 is similar to ball glove 10 described above except that ball glove 410 comprises three different spin reducing textures 452-1, 452-2 and 452-3 (collectively referred to as textures 452). Textures 452 provide different regions on the palm side of ball glove 410 with different spin reducing and ball gripping characteristics. In the example illustrated, spin reducing texture 452-1 extends on the palm side of glove 410 below each of the front stall portions 34 of the ball glove 410 to the hand opening or mouth 455 of the glove 410. Spin reducing texture 452-2 extends on the front stall portions 34 of ball glove 410 including at least the front stall portions 34 of finger stalls 20, 22 and thumb stall 28. Spin reducing texture 452-3 extends on the front side 458 of webbing 416.

Figure 34:
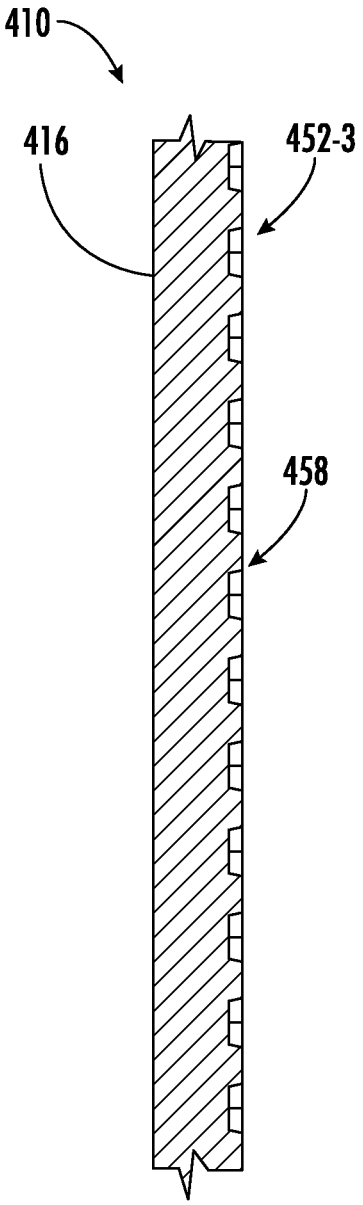
FIG. 34 is a sectional view of the palm or front side of the ball glove FIG. 33 taken along line 34-34.
Figure 35:
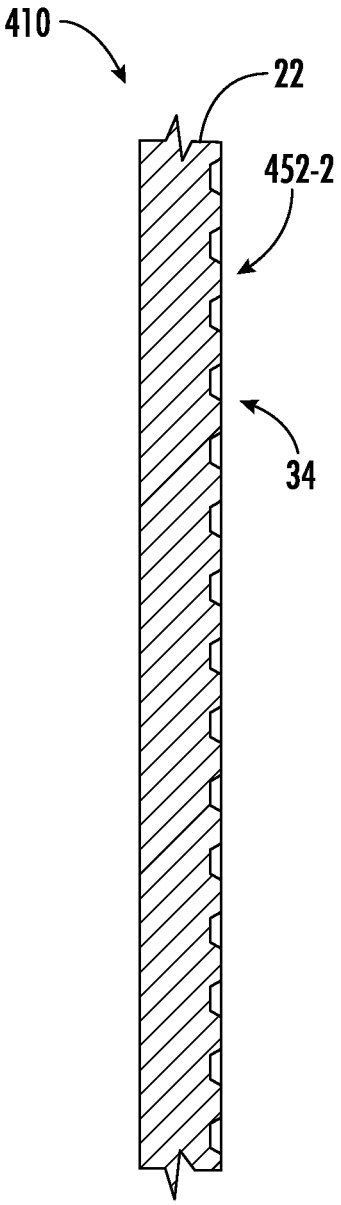
FIG. 35 is a sectional view of the palm or front side of the ball glove of FIG. 33 taken along line 35-35.
Figure 36:
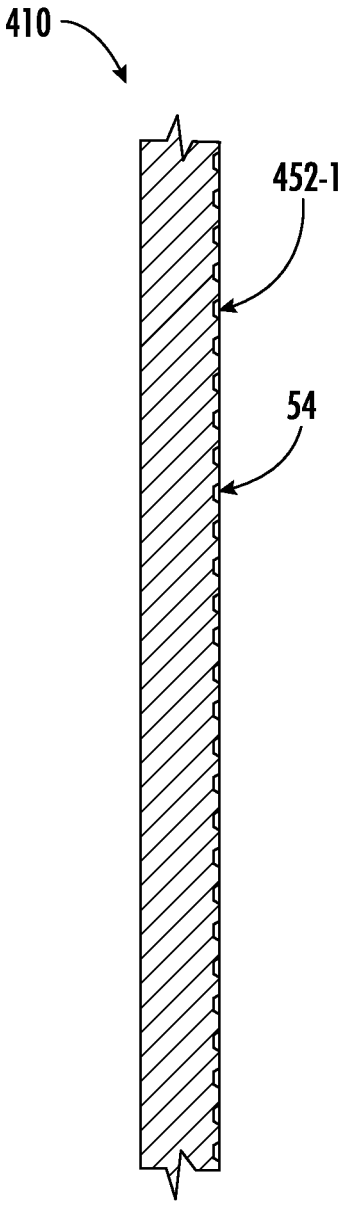
FIG. 36 is a sectional view of the palm or front side of the ball below of FIG. 33 taken along line 36-36.

In the illustrated example, spin reduction texture 452-3 has pattern of diamond-shaped raised projections and/or recesses similar to the pattern shown in FIG. 19. Spin reducing textures 452-1 and 452-2 have patterns similar to the pattern shown in FIG. 14. As shown by FIGS. 34 and 35, the spin reducing textures 452-2 and 452-3 are deeper relative to spin reducing texture 452-1. In some implementations, spin reducing texture 452-3 offers the greatest amount of friction with respect to a spinning ball. Spin reducing texture 452-2 offers an amount of friction less than that of texture 452-3, but greater than that of texture 452-1. As a result, those portions of ball glove 410, which initially contact a caught ball have the greatest coefficient of friction.

In other implementations, spin reducing textures 452 may have other patterns, such as any of the other pattern shown in FIGS. 13-22 and may have other depths or other combinations of different depths. In some implementations, the provision of different textured regions on different portions of the front side of glove 410 may vary in accordance with a player's preference. In some implementations, the provision of different textured regions on different portions of the front face of ball glove 410 may vary depending upon the position of the player using glove 410. For example, an infielder may have a different combination of spin reducing textures at different locations or regions of ball glove 410 as compared to a ball glove 410 for use by an outfielder.

Figure 37:
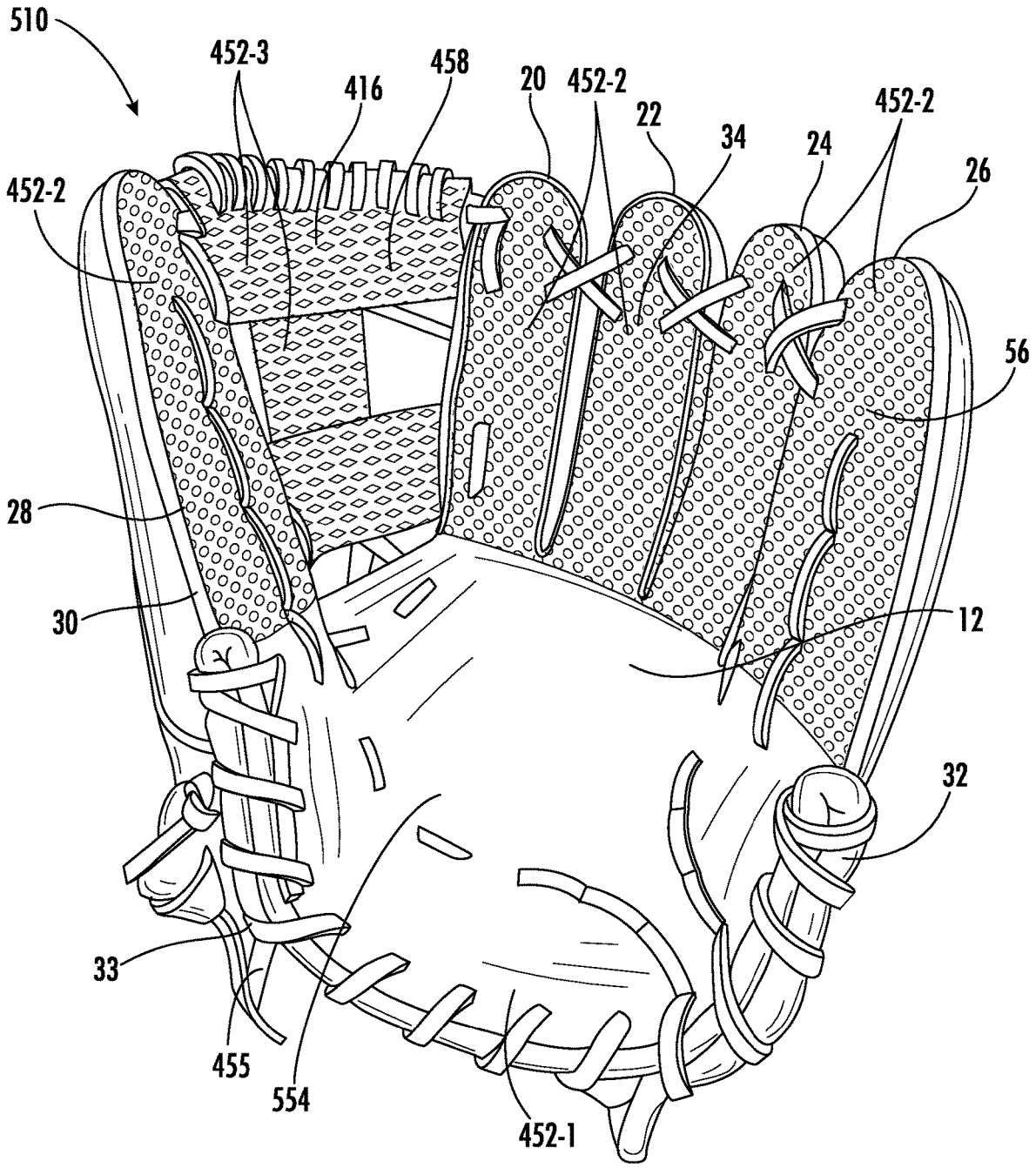
FIG. 37 is a palm or front side perspective view of an example ball glove in accordance with one implementation.

FIG. 37 illustrates an example ball glove 510 having spin reduction textures on selected portions of the front side 12 of the ball glove 510. Ball glove 510 is similar to ball glove 410 described above, except that ball glove 510 omits any spin reduction technology or texture in palm region 554. As a result, once the rotational speed or spin of the ball has been reduced due to initial impact with the spin reduction textures 452-2 and 452-3, the ball may move to palm region 554, where due to the omission of any spin reduction texture that might otherwise grip the ball, the player may more easily remove the ball from glove 510. In some implementations, the front stall portions 34 may also omit any spin reduction texture such as texture 452-2. In other implementations, one or both of the front stall portions 34 and/or the thumb stall 28 may omit any spin reduction texture.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A ball glove comprising:

a back glove portion;

a front glove portion coupled to the back glove portion to define a hand cavity and to form a plurality of finger stalls and a thumb stall, the front glove portion comprising a palm sub-portion, a fingerstall sub-portion and a thumb stall sub-portion, and a webbing coupled to, and positioned between, one of the plurality of finger stalls and the thumb stall, wherein a palm side of the webbing comprises a first region comprising a spin reduction texture, the spin reduction texture comprising a two-dimensional array of spaced and isolated individual recesses; and wherein the palm sub-portion comprises a second region comprising a second spin reduction texture, the second spin reduction texture comprising a second two-dimensional array of spaced and isolated second individual recesses, wherein the palm sub-portion comprises a layer of leather material and wherein the spaced and isolated second individual recesses of the second spin reduction texture each extend into a surface of the leather material, wherein the spaced and isolated individual recesses each have a first depth and wherein each of the second individual recesses have a second depth less than the first depth.

2. The ball glove of claim 1, wherein each of the fingerstall sub-portion, and the thumb stall sub-portion comprises a third region comprising a third spin reduction texture, the third spin reduction texture comprising a third two-dimensional array of spaced and isolated third individual recesses, each of the third individual recesses having a third depth greater than the second depth.

3. The ball glove of claim 2 further comprising lacings extending over a portion of the spaced and isolated third individual recesses with the spaced and isolated third individual recesses underlying portions of the lacings.

4. The ball glove of claim 3, wherein the lacings connect the plurality of finger stalls.

5. The ball glove of claim 1, wherein the spaced and isolated individual recesses of the spin reduction texture each have a first shape and wherein the second spaced and isolated individual recesses of the second spin reduction texture each have a second shape different than the first shape.

6. The ball glove of claim 5, wherein the first shape is a diamond and wherein the second shape is round.

7. The ball glove of claim 1, wherein the at least one of the front glove portion and the back glove portion further includes at least one marking selected from the group consisting of a trademark, a symbol, alphanumeric indicia, and combinations thereof.

8. The ball glove of claim 1, wherein the plurality of finger stalls comprises first, second and third finger stalls.

9. The ball glove of claim 1, wherein the plurality of finger stalls comprises first, second, third and fourth finger stalls.

10. The ball glove of claim 1, wherein the spin reduction texture uniformly extends across an entire area of the palm side of the webbing.

11. The ball glove of claim 1, wherein a back side of the webbing comprises a third region comprising a third a two-dimensional array of spaced and isolated third individual recesses.

12. The ball glove of claim 11 further comprising lacings that extend over a portion of the spaced and isolated third individual recesses with the spaced and isolated third individual recesses underlying portions of the lacings.

13. The ball glove of claim 1 further comprising lacings extending over a portion of the spaced and isolated individual recesses with the spaced and isolated individual recesses underlying portions of the lacings.

* * * * *